US007245854B2

(12) United States Patent
Miyaji et al.

(10) Patent No.: US 7,245,854 B2
(45) Date of Patent: Jul. 17, 2007

(54) IMAGE FORMING APPARATUS WITH WHEELCHAIR ACCESSIBILITY

(75) Inventors: Tatsuo Miyaji, Kanagawa (JP); Masayuki Enta, Kanagawa (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 0 days.

(21) Appl. No.: 10/702,092

(22) Filed: Nov. 6, 2003

(65) Prior Publication Data

US 2004/0131384 A1 Jul. 8, 2004

(30) Foreign Application Priority Data

Nov. 7, 2002 (JP) ..... P2002-323602
Jun. 18, 2003 (JP) ..... P2003-173716
Aug. 11, 2003 (JP) ..... P2003-291112

(51) Int. Cl.
*G03G 15/00* (2006.01)
*G03G 21/00* (2006.01)

(52) U.S. Cl. ..... 399/124; 399/393; 399/391

(58) Field of Classification Search ..... 399/124, 399/391, 393, 394
See application file for complete search history.

(56) References Cited

FOREIGN PATENT DOCUMENTS

| | | | |
|---|---|---|---|
| JP | 03079519 A | * | 4/1991 |
| JP | 6-148960 | | 5/1994 |
| JP | 06247569 A | * | 9/1994 |
| JP | 7-157140 | | 6/1995 |
| JP | 2000122362 A | * | 4/2000 |

* cited by examiner

*Primary Examiner*—David M. Gray
*Assistant Examiner*—Ryan Gleitz
(74) *Attorney, Agent, or Firm*—Morgan, Lewis & Bockius LLP

(57) ABSTRACT

A sheet storing portion storing a stack of recording sheets and sequentially supplying recording sheets to an image forming portion has a tray pullout frame that can be pulled out to the front side of the apparatus and a sheet tray provided in the tray pullout frame. The sheet tray stores recording sheets, and the tray pullout frame can be pulled out to a lateral side while the frame is mounted in the apparatus. The front part of the tray pullout frame can be open as the frame is mounted to the apparatus main body, so that the recording sheet transport path can be open and the apparatus can be restored upon a paper jam.

12 Claims, 21 Drawing Sheets

IMAGE FORMING APPARATUS WITH WHEELCHAIR ACCESSIBILITY

BACKGROUND OF THE INVENTION

1. Field of the Invention

The present invention relates to an image forming apparatus that forms a visible image on a recording medium, and more particularly, to an image forming apparatus that allows an operator to easily operate the apparatus while being seated in a wheelchair as well as while standing in front of the apparatus.

2. Description of the Related Art

In recent years, more people with handicaps have come to work in society. Therefore, wheelchair users have more opportunities to use an image forming apparatus such as a copier, a printer, and a facsimile machine in offices and other places while they are seated in their wheelchairs. Therefore, there is a demand for such an image forming apparatus that can easily be operated by an operator seated in a wheelchair or the like.

Among various conventional image forming apparatuses widely used today, one image forming apparatus according to electrophotography allows an operator to stand in front of the apparatus during operation. The image forming apparatus is widely applied to machines such as a multi-function machine serving as a copier, a printer and a facsimile machine and a color copier. As shown in FIG. 22, the apparatus includes a recording sheet storing portion 201 in the lower part of the apparatus, and an image forming portion 202 in the upper part. Recording sheets sequentially fed from the recording sheet storing portion 201 are transported upwardly along the apparatus side surface S, and a toner image is transferred onto a recording sheet at the image forming portion 202. The recording sheet holding a toner image yet to be fixed is transported to a fixation device, has its image formed into a fixed image by pressurizing and heating, and is then discharged onto a discharge tray 203 provided above the image forming portion.

An image reading portion 204 is supported by pillars 205 above the image forming portion, and a document platen glass (not shown) and a document cover 206 to cover the document platen glass are provided on the top surface. A document surface placed on the document platen glass is exposed to light and the image can be read. Furthermore, in front of the document platen glass, an operation portion 207 to operate the entire apparatus is provided and the portion has a display for displaying necessary information, input keys and the like.

The above described recording sheet storing portion 201 has a plurality of paper feed trays 210 placed upon each other in the vertical direction so that paper sheets in different sizes can be stored. The trays can each be pulled out to the front and replenished with recording sheets. The side surface of the apparatus main body can be open along the path for transporting recording sheets from the recording sheet storing portion 201 to the image forming portion 202. Therefore, when there is a paper jam, the paper transport path can be opened from the lateral side surface S, and the stuck sheet can be removed.

The image forming apparatus is however based on the idea that a typical user is a non-handicapped person that stands in front of the apparatus main body and operates the apparatus, and therefore a wheelchair user might find the apparatus difficult to use. Therefore, there have been suggested apparatuses that allow for improved operability by wheelchair users. For example, one such apparatus disclosed has an elevating device at the part supporting the apparatus main body, so that the entire apparatus is moved up and down as required according to circumstances in operation, as disclosed in JP-A-7-157140. In a conventional apparatus, the document platen for placing a document is positioned too high for a wheelchair user, and the document cover is not easy to lift up/down. The far side of the document platen glass is hardly in view, and therefore a document sheet cannot be placed correctly on the document platen glass. The above image forming apparatus is directed to a solution to these disadvantages. When a wheelchair user faces the apparatus from the front, the footrests of the wheelchair meet the lower part of the apparatus and blocks the user from further approaching the apparatus for operation. In this view point, an image forming apparatus having a recessed part in the lower part of the apparatus to let the footrests to enter has been proposed, JP-A-6-148960.

However, the following other problems are encountered when a wheelchair user tries to operate an image forming apparatus.

In the conventional apparatus, a feed tray must be pulled out considerably forward to be replenished with paper sheets. This is not easily done when a user is seated in a wheelchair that obstructs the operation. Such an apparatus that allows the sheet tray to be pulled out to a lateral side may be considered, but this lowers the operability by a non-handicapped user as compared to the apparatus with the sheet tray that can be pulled out forward.

Most conventional apparatuses include a paper transport path on a lateral side of the apparatus, and therefore the paper path provided along the side surface of the apparatus must be opened to remove a sheet stuck in the path upon a paper jam. At the time, the operator must come around to the lateral side of the apparatus for operation, and the user in a wheelchair must move from the front to the lateral side of the apparatus. In the apparatus disclosed by JP-A-7-157140, upon a paper jam, the entire apparatus moves up and down to move a stuck paper sheet to a location where the paper can easily be removed. However, the operator in front of the apparatus cannot easily remove the stuck recording sheet from the transport path on the lateral side surface.

SUMMARY OF THE INVENTION

The present invention is in consideration of the foregoing circumstances, and it is an object of the invention to provide an image forming apparatus that allows an operator in a wheelchair to readily carry out the operation of removing a stuck recording paper sheet and resuming driving and the operation of replenishing recording paper sheets.

An image forming apparatus according to a first aspect of the invention is in consideration of the above described disadvantages. In the image forming apparatus, recording sheets are sequentially fed from a sheet storing portion that stores a stack of recording sheets and visible images are formed on the recording sheets in the image forming portion. The sheet tray that stores recording sheets can be pulled out in any of two directions substantially orthogonal to each other. More specifically, in the apparatus, the sheet tray can be pulled out either to the front or a lateral side. Therefore, when a non-handicapped person tries to replenish the sheet tray with recording sheets, the person can pull out the sheet tray forward from the apparatus and can readily replenish the tray with sheets. A wheelchair user operating in front of the apparatus can pull out the sheet tray to the lateral side and replenish the tray with recording sheets even if he/she cannot pull out the sheet tray forward by the presence of the wheelchair.

In the above structure in which the sheet tray can be pulled out in the two directions, the sheet tray for example is set in a tray pullout frame that can be pulled out in one direction relative to the main body of the apparatus, and the sheet tray can be pulled out in a direction substantially orthogonal to the direction in which the pullout frame is pulled out relative to the main body of the apparatus.

In addition, when the sheet tray can be pulled out in the two directions, a handle to pull out the sheet tray is necessary on each of two upright surfaces of the apparatus, and these must not obstruct the tray from being pulled out in the two directions. Therefore, a handle unit detachable from the sheet tray may be employed. The handle unit is engaged and coupled with the sheet tray as the tray pullout frame is mounted in the apparatus main body. When the handle unit is pulled out, the sheet tray coupled therewith can be pulled out in the horizontal direction. When the tray pullout frame is pulled out, the sheet tray and the handle unit are disengaged, so that the handle unit can be supported without changing its position to the apparatus main body, and the sheet tray can be pulled out in a different direction together with the tray pullout frame.

In a typical apparatus, a plurality of sheet trays are placed on each other in the vertical direction and a transport path to transport a recording sheet fed from the sheet trays is provided along the front or a lateral side of the main body of the apparatus so that the apparatus may be restored upon a trouble such as a paper jam. At the time, when the sheet tray can be pulled out in two directions, the path to pull out the sheet tray and the sheet transport path sometimes cross. On the other hand, according to the invention, the direction in which the tray pullout frame having the sheet tray thereon is pulled out and the direction in which the recording sheets are pulled out from the sheet tray are set in the same direction. The transport path that transports recording sheets pulled out from one sheet tray penetrates in the vertical direction through the tray pullout frames having the other sheet trays thereon.

In this way, the transport path is penetrated while the tray pullout frames are all mounted, and the recording sheets can be sent to the image forming portion. When the tray pullout frame is pulled out, the transport path is disconnected and a part of the transport path is pulled out together with the tray pullout frame. Therefore, when the direction in which recording sheets are fed from the sheet tray and the direction in which the tray pullout frame is pulled out are the same, both functions can be carried out at a time, so that images can be formed and recording sheets can be replenished smoothly.

As the transport path is formed as described above, the front part of the tray pullout frame can be open so that the transport path is exposed while the tray pullout frame is stored in the main body of the apparatus. In this way, while the tray pullout frame is stored in the main body of the apparatus, a stuck recording sheet can be removed. Note that depending on the condition of the paper jam, the tray pullout frame may be pulled out to remove the stuck recording sheet. However, if the recording sheet is stuck through two or more tray pullout frames, pulling out only one of the trays could tear the sheet, and the torn recording sheet could not be easily removed. In contrast, if the transport path can be open at the front part of the tray pullout frame as described above, the above described trouble can be avoided.

When the direction of pulling out the tray pullout frame and the direction of feeding recording sheets are the same, a feed paper roll that sequentially feeds recording sheets from the sheet tray is supported by the tray pullout frame. In this way, both the operation of feeding the recording sheets and the operation of pulling out the tray pullout frame can smoothly be carried out.

In this manner, when only the sheet tray is pulled out, the sheet tray can be supported pivotably in the horizontal direction around the lateral back of the sheet tray in the tray pullout direction. In this way, an operator seated in a wheelchair in front of the apparatus main body can pull out a sheet tray to a lateral side and pivot the tray to the front side, so that the sheet tray comes near the operator, and the operator can easily replenish recording sheets.

An image forming apparatus according to a second aspect of the invention includes an image forming portion that forms a visible image on a recording paper sheet, a recording paper sheet storing portion that stores a plurality of recording paper sheets and sequentially feeds recording paper sheets to the image forming portion, a discharge tray provided above the image forming portion for holding recording paper sheets discharged from the image forming portion, an operation portion for inputting a driving signal for the image forming portion, and a paper sheet transport path that transports a recording paper sheet taken out from the recording paper sheet storing portion along the front surface where the operation portion is provided to the discharge tray through the image forming portion. The paper sheet transport path includes a transport path cover open to the front side. The recording paper sheet storing portion includes a paper feed tray that can be pulled out to a lateral side. The recording paper sheet storing portion may have a plurality of paper feed trays placed on each other in the vertical direction and each of the paper feed trays preferably has a handle at its front side end used to pull out the paper feed tray.

The paper feed tray can be supported pivotably in the horizontal direction around the back of the paper feed tray in the tray pullout direction toward the front side of the main body of the image forming apparatus while the paper feed tray is pulled out from the image forming apparatus. In this support structure, for example one of the rotating shaft in the vertical direction and a bearing holding the rotating shaft rotatably around the axis line is fixed to the paper feed tray, and the other is fixed to the main body of the image forming apparatus. Then, the paper feed tray is pivoted around the rotating shaft. The rotating shaft and the bearing can be attached/detached to/from each other by the pullout operation of the paper feed tray and the rotating shaft is mounted to the bearing while the paper feed tray is pulled out. In this way, the paper feed tray can pivot around the rotating shaft toward the front side.

Meanwhile, the transport path cover is preferably divided into a plurality of parts in the vertical direction, each the transport path cover part is preferably pivoted around the horizontal axis line to open the paper transport path, and the height-wise sizes of the transport path cover parts are preferably substantially the same.

In the image forming apparatus, a recording paper sheet taken out from the recording paper sheet storing portion is fed into the image forming portion through the paper sheet transport path provided along the front surface of the apparatus. Upon a paper jam in the paper sheet transport path or the image forming portion, the transport path cover part is open to the front side. Therefore, the operator can readily carry out the operation of removing the stuck recording paper sheet that requires close observation of the circumstances without moving. In the operation of replenishing recording paper sheets can be carried out by the operator in front of the apparatus without any problem because the paper feed tray is pulled out to a lateral side.

A handle used to pull out the paper feed tray is provided at the front end of the paper feed tray, and therefore the operator in front of the apparatus can readily pull out the paper feed tray to a lateral side using the handle.

In addition, the paper feed tray is pivoted in the horizontal direction to the front side as it is pulled out from the apparatus main body and comes near the operator in front of the apparatus main body. Consequently, the operator in a wheelchair can readily replenish the tray with recording paper sheets in front of the apparatus main body without moving.

Meanwhile, the transport path cover open to the front side is divided into a plurality of parts, so that the size of each of the parts can be small, and its forward protruding length can be small when each transport path cover part is pivoted along the horizontal axis line to open the paper sheet transport path. Therefore, the operator in a wheelchair can carry out the operation in the position close to the apparatus rather than being much apart from the apparatus main body. A slightly difficult operation such as sufficiently observing the state of a stuck recording paper sheet and appropriately removing the sheet can be carried out readily and surely. Upon a paper jam, the operator does not have to move to open the paper sheet transport path.

As in the foregoing, in the image forming apparatus according to the invention, the paper sheet transport path is open to the front side of the apparatus, and a wheelchair user can restore the apparatus upon a paper jam without moving, and can appropriately address the trouble near the apparatus main body. The paper feed tray can be pulled out to a lateral side using a handle provided at the front side. Therefore, the operator in a wheelchair can readily replenish the tray with recording paper sheets from the front side without moving. Furthermore, when the paper feed tray is pivoted to the front side, the operator can more easily replenish the tray with recording paper sheets.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Embodiments of the present invention will be described in conjunction with the drawings.

Figure 1:
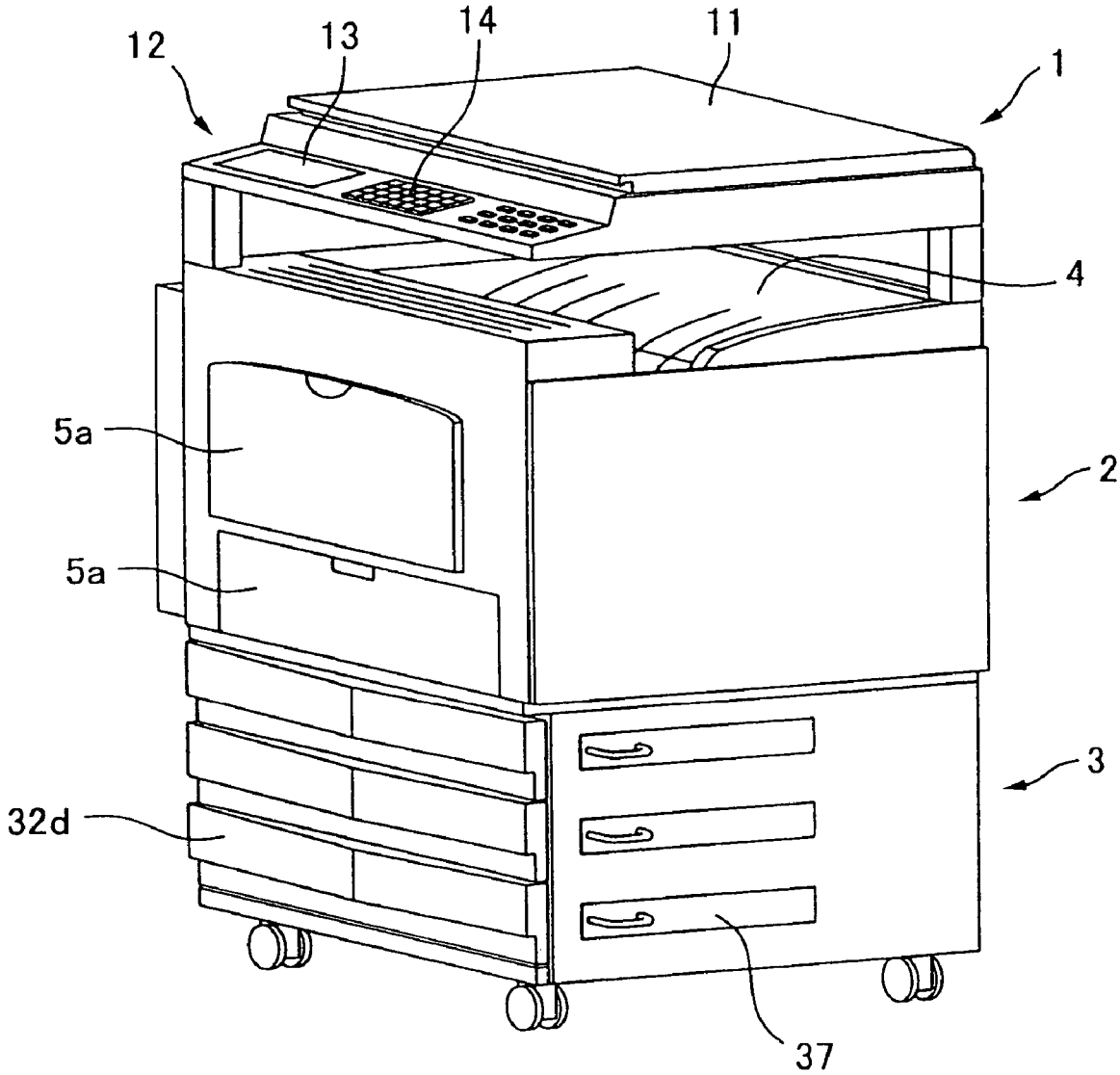
FIG. 1 is a schematic perspective view of an image forming apparatus according to one embodiment of the invention.
Figure 2:
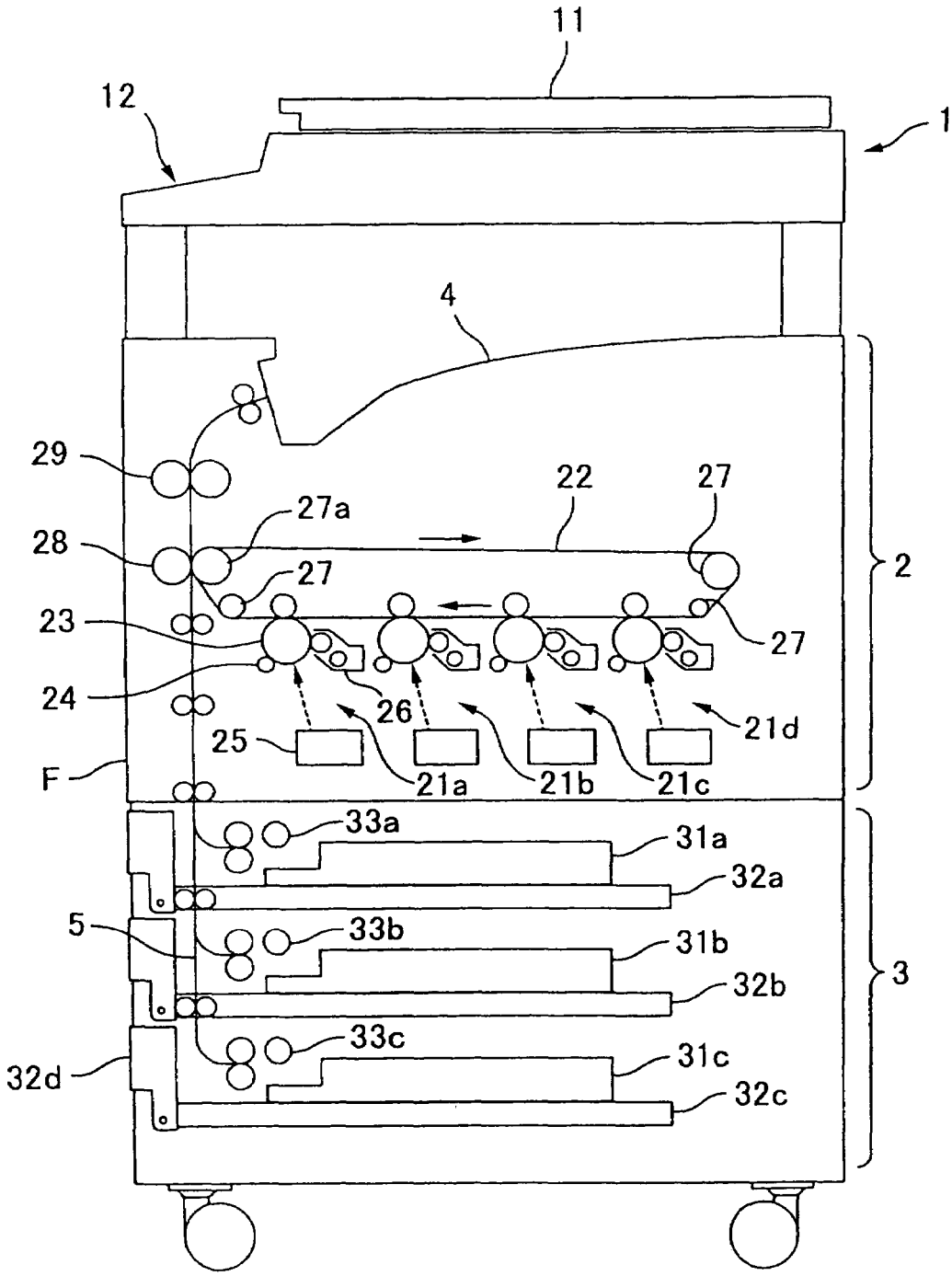
FIG. 2 is a schematic view of the image forming apparatus shown in FIG. 1.

FIG. 1 is a perspective view of an image forming apparatus according to a first embodiment of the invention. FIG. 2 is a schematic view of the image forming apparatus.

The image forming apparatus includes an image reading portion 1 that reads a document image and converts the image into an electrical image signal, an image forming portion 2 that forms a toner image based on the image signal and fixes the image on a recording sheet, and a recording sheet storing portion 3 that sequentially supplies recording sheets to the image forming portion 2.

The image reading portion 1 has a document platen glass (not shown) and a document cover 11 covering the platen glass, and irradiates a document placed on the document platen glass with light from below. The reflected light is detected by a sensor and the result is converted into an image signal. The document cover 11 is pivoted to have its one side jumped up, so that the document platen is open, and an operation portion 12 is provided on the side to open the document cover 11, in other words, on the front side. The operation portion 12 has a display device 13 and an input key 14, and the operator can input image forming conditions or the like while reading what is displayed at the display device 13.

The image forming portion 2 includes four image forming units 21*a*, 21*b*, 21*c*, and 21*d* which form toner images in cyan, yellow, magenta, and black, respectively. The toner images are transferred as they are placed on each other on an intermediate transfer belt 22 that is driven to go around. In this way, a full-color toner image is formed.

The image forming units 21 each have a cylindrical photoreceptor drum 23, a charger 24 that homogeneously charges the circumferential surface of the drum, an image exposure device 25 that irradiates the circumferential surface of the photoreceptor drum with light and forms an electrostatic latent image, and a developing device 26 that transfers toner onto the electrostatic latent image to form a toner image.

The intermediate transfer belt 22 runs on a plurality of support rollers 27, and the rollers are supported parallel to the front surface F of the apparatus main body, so that the intermediate transfer belt 22 goes around in the front-back direction of the apparatus main body and opposes a transfer roller 28 near the front side of the apparatus. Transfer bias voltage is applied between the transfer roller 28 and an opposing support roller 27*a*, and the toner image on the intermediate belt 22 is transferred on a recording sheet transported along the front surface of the apparatus.

A fixation device 29 is provided above the position of the transfer roller 28, and the toner image transferred on the recording sheet is heated/pressurized for fixation on the sheet. The recording sheet having the toner image fixed thereon is discharged into the discharge tray 4 provided above the image forming portion 2.

The recording sheet storing portion 3 includes three sheet trays 31*a*, 31*b*, and 31*c* that store recording sheets indifferent sizes and feed recording sheets on a one-sheet-basis, and these sheet trays are provided in tray pullout frames 32*a*, 32*b*, and 32*c*, respectively. The tray pullout frames 32 support paper feed rolls 33*a*, 33*b*, and 33*c* that sequentially feed recording sheets on a one-sheet-basis. A transport path 5 that transports a recording sheet to the image forming portion is divided corresponding to the three tray pullout frames described above, and the transport path from the lowermost sheet tray 31*c* penetrates in the vertical direction through the paths for the upper tray pullout frames 32*a* and 32*b*.

Figure 3:
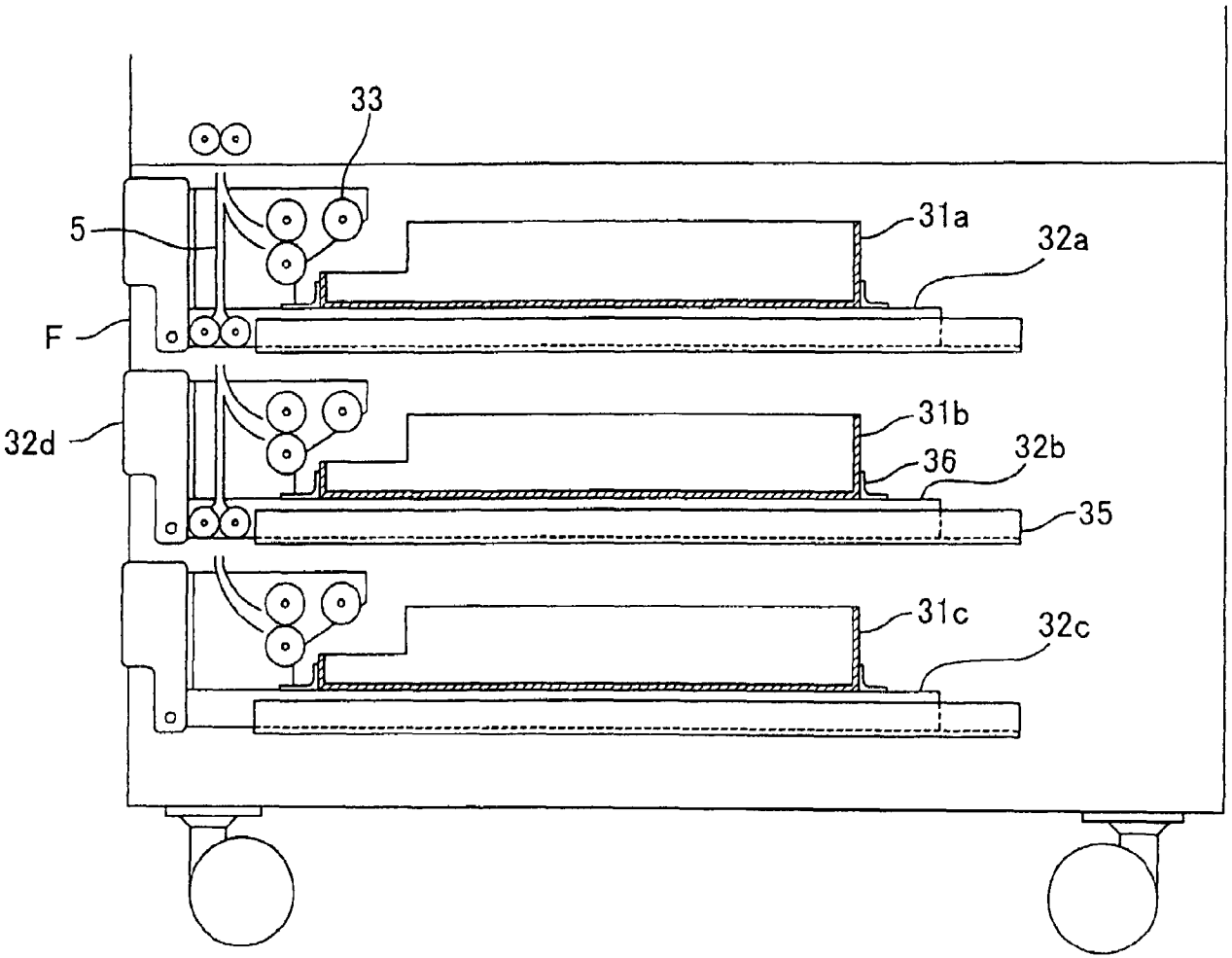
FIG. 3 is an enlarged view of a recording sheet storing portion in the image forming apparatus shown in FIG. 1.
Figure 4:
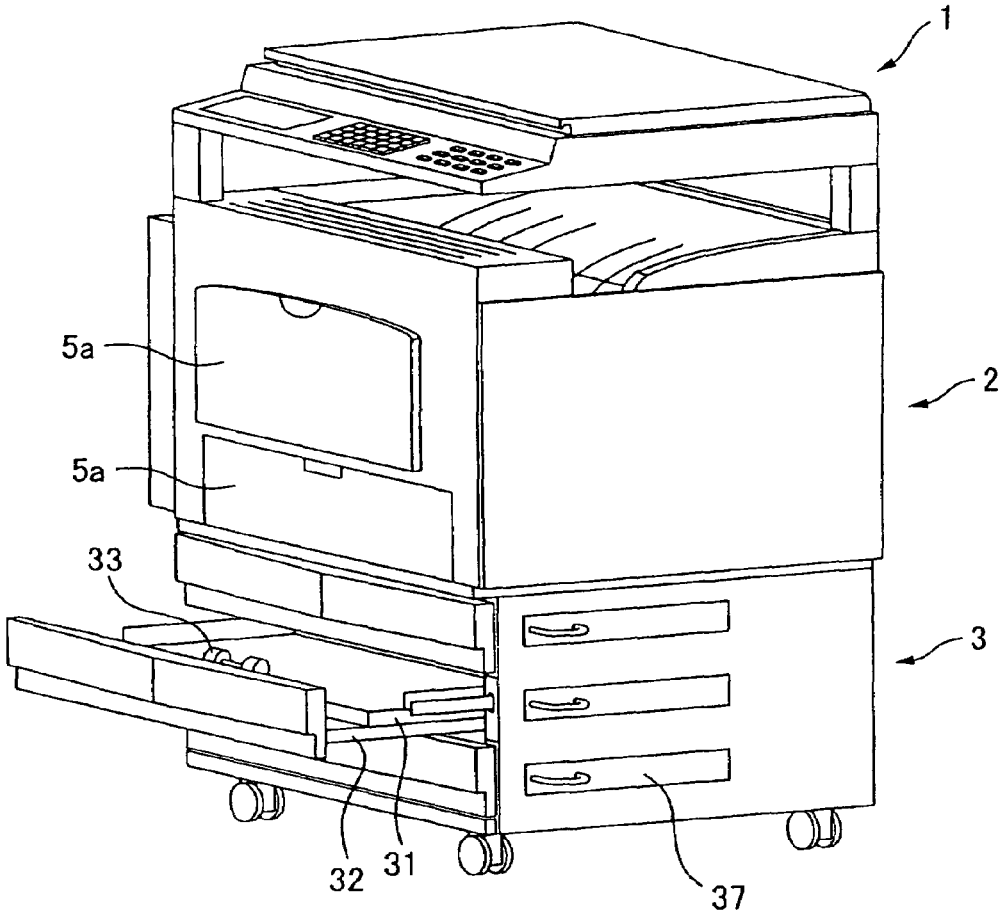
FIG. 4 is a schematic perspective view showing the state in which a tray pullout frame in the image forming apparatus in FIG. 1 is pulled out.

As shown in FIG. 3, the tray pullout frames 32 are supported such that they can each be pulled out forward from the front side of the apparatus main body along a first guide rail 35 fixed to the apparatus main body. As shown in FIG. 4, the tray pullout frames 32 are pulled out forward, so that the sheet trays 31 thereon and the feed rolls 33 are pulled out together. The transport path 5 is disconnected when one of the tray pullout frames 32 is pulled out, and only the part in the tray pullout frame is pulled out forward. When the tray pullout frame 32 is mounted back to the apparatus main body, the transport path 5 returns to the connected path, and recording sheets can be transported to the image forming portion 2.

Figure 5:
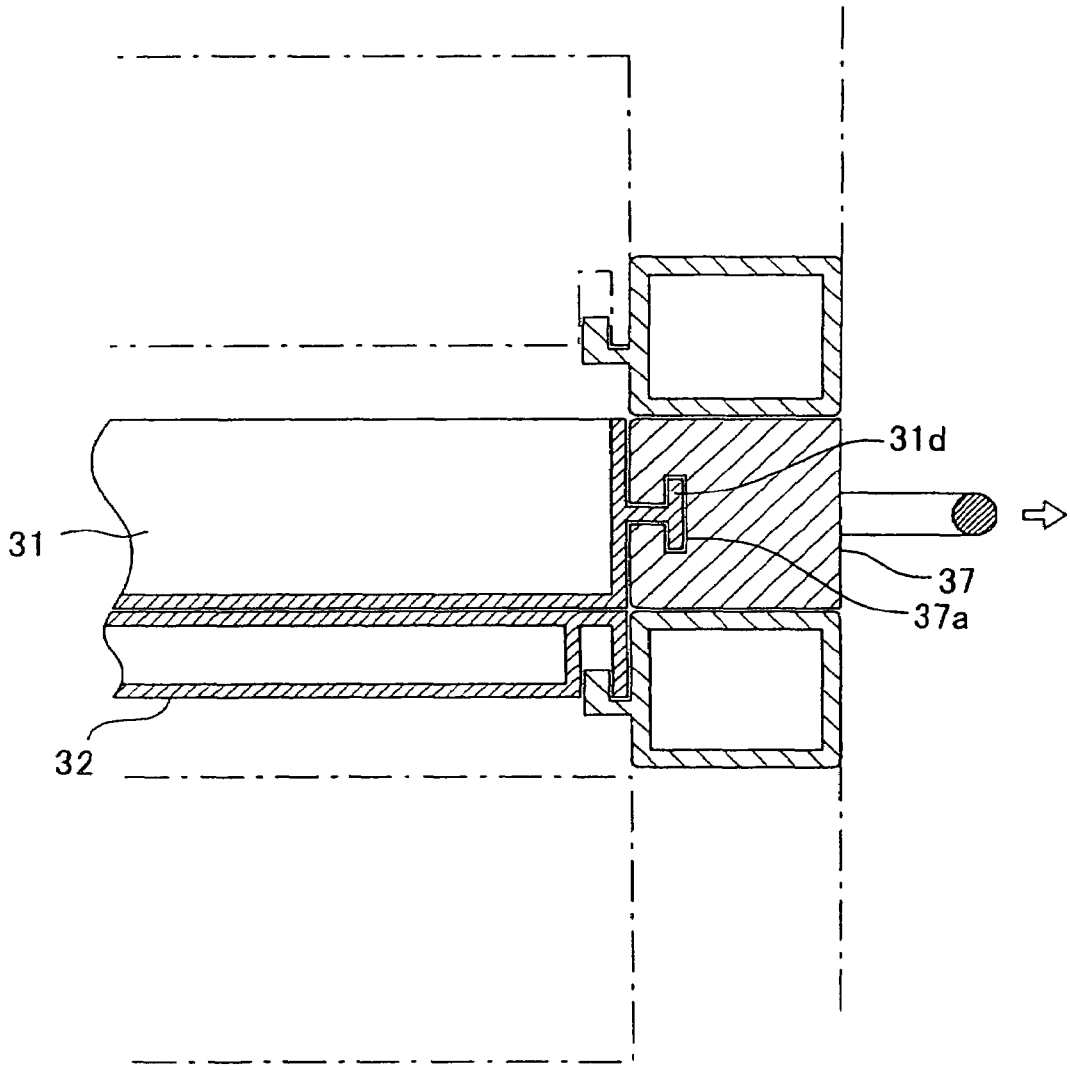
FIG. 5 is a sectional view of the engaged part between the sheet tray and the handle unit in the image forming apparatus in FIG. 1.
Figure 6:
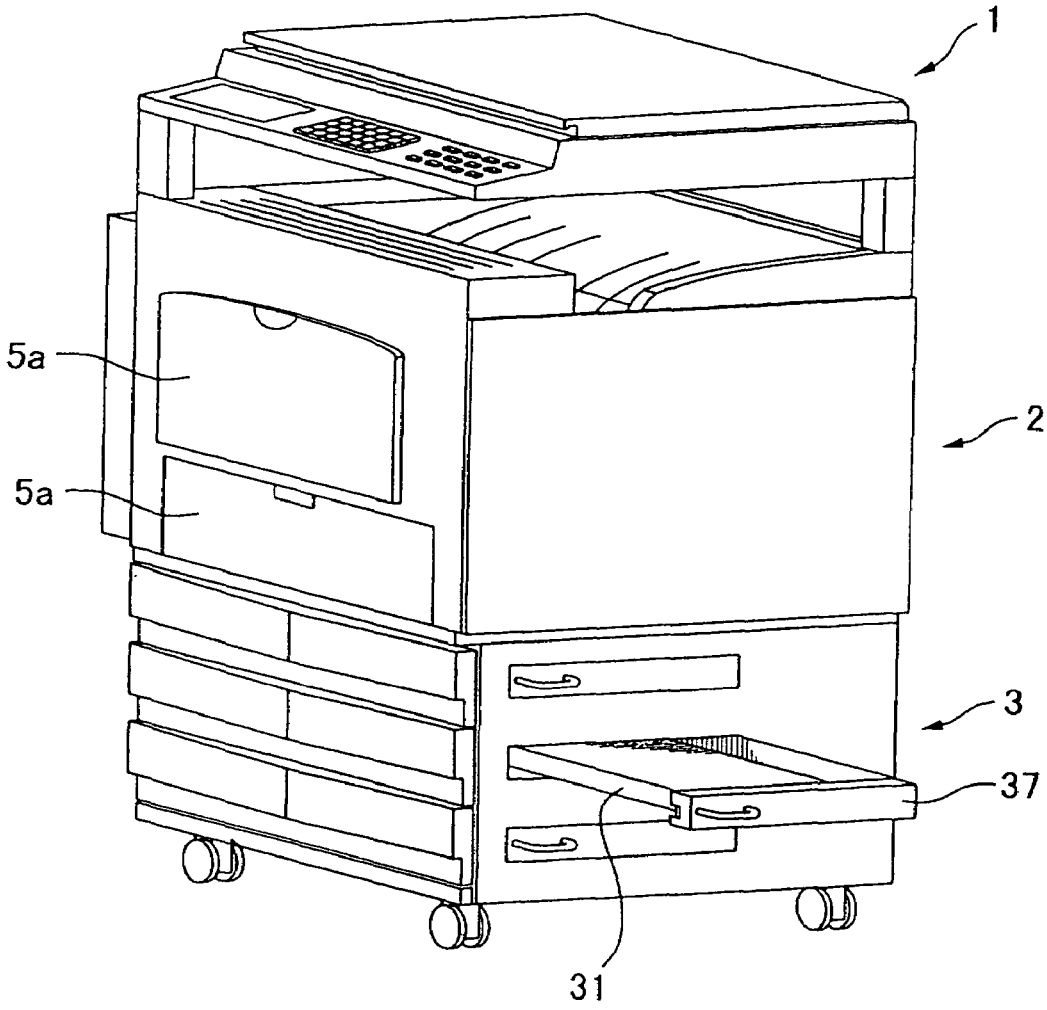
FIG. 6 is a schematic perspective view showing the state in which the sheet tray in the image forming apparatus in FIG. 1 is pulled out.

The sheet tray 31 is supported such that the tray can be pulled out along a second guide rail 36 fixed to the tray pullout frame 32 in the direction orthogonal to the direction in which the tray pullout frame 32 is pulled out. When the tray pullout frame 32 is mounted to the apparatus main body, the sheet tray 31 is engaged with a handle unit 37 supported at the apparatus main body. As shown in FIG. 5, the handle unit 37 has a groove 37*a* having a T shape in a section in the horizontal direction at the inner surface of the apparatus, and the direction in which the groove 37*a* runs coincides with the direction of the tray pullout frame 32. When the tray pullout frame 32 is mounted to the apparatus main body, a protrusion 31*d* in the T-shaped section corresponding to the groove 37*a* provided in the sheet tray 31 is inserted to the groove, so that the sheet tray 31 and the handle unit 37 are engaged. When the handle tray unit 37 is pulled out to the lateral side while the sheet tray 31 and the handle unit 37 are engaged, the sheet tray 31 is pulled out to the lateral side as it is coupled as shown in FIG. 6, and can be replenished with recording sheets from the lateral side.

Figure 7:
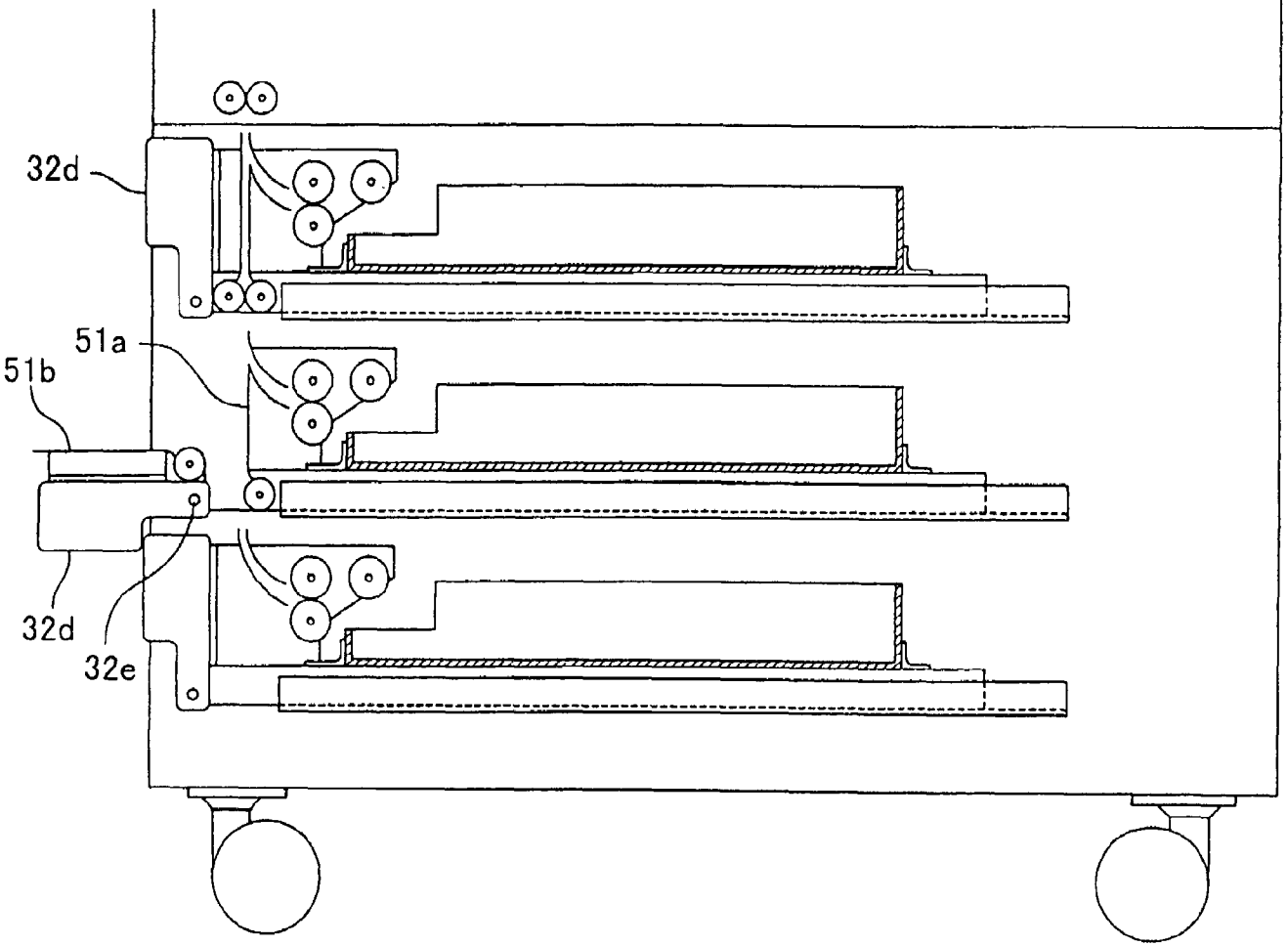
FIG. 7 is a schematic view showing the state in which the front cover of the tray pullout frame in the image forming apparatus in FIG. 1 is pulled out.

The transport path 5 to the image forming portion 2 from the sheet tray 31 is provided to transport a recording sheet upwardly along the front surface F of the apparatus main body. The sheet is transported upwardly from the location where the intermediate transfer belt 22 and the transfer roller 28 meet further along the front surface F of the apparatus to the discharge tray 4 through the fixation device 29. The transport path 5 can be opened through the opening/closing portion 5*a* for the transport path in the image forming portion 2 so that a stuck recording sheet upon a paper jam in the image forming portion can be removed. As shown in FIG. 7, the front cover 32*d* at the front part of the tray pullout frame 32 can open forward. As for the part of the transport path 5 in the tray pullout frame 32, when the front cover 32*d* is opened, sheet guides 51*a* and 51*b* that guide the front and back surfaces of the recording sheet separate, so that the transport path 5 can be opened. In this way, when the recording sheet is stopped as it penetrates through the plurality of tray pullout frames 32 provided above and below in the vertical direction, the tray pullout frame 32 is not forcibly pulled out and therefore the recording sheet is not torn and can be removed quickly by opening the front cover 32*d*.

As shown in FIG. 7, the front cover 32*d* has its lower end coupled with the tray pullout frame 32 by the pivotal shaft 32*e* in the horizontal direction, so that the upper part comes forward to open.

In the image forming apparatus as described above, a non-handicapped operator can pull out the tray pullout frame 32 forward and readily replenish the sheet tray 31 provided in the tray pullout frame 32 with recording sheets if necessary. Meanwhile, a wheelchair user comes and stops near the front side of the apparatus main body in the wheelchair and operates the apparatus using the operation portion 12 provided on the front side. Therefore, it is difficult for the operator in the wheelchair to pull out the tray pullout frame 32 forward by the presence of the wheelchair but the operator can pull the handle provided on the side of the apparatus main body to the lateral side. In this way, the handle unit 37 and the sheet tray 31 are pulled out as they are coupled and the tray can be replenished with recording sheets.

In the step of forming an image, the transportation of a recording sheet can be obstructed for some reason. In such a case, the recording sheet stops somewhere in the transport path 5, which causes a paper jam. In order to continue the image forming operation, the recording sheet stopped in the path must be removed. At the time, the opening/closing portion 5*a* for the transport path or the front cover 32*d* of the tray pullout frame is opened, and the stuck recording sheet is removed. Since the opening/closing portion 5*a* for the transport path and the front cover 32*d* are provided on the front side of the apparatus, the operator can remove the stuck recording sheet without moving from the normal operation position. Therefore, an operator in a wheelchair can readily carry out the operation. The front cover 32*d* is provided for each of the tray pullout frames 32, and the upper part does not protrude much when it is opened forward. Therefore, the operator in the wheelchair can operate in front of the apparatus and the transport path 5 is not obstructed by the presence of the wheelchair.

Figure 8:
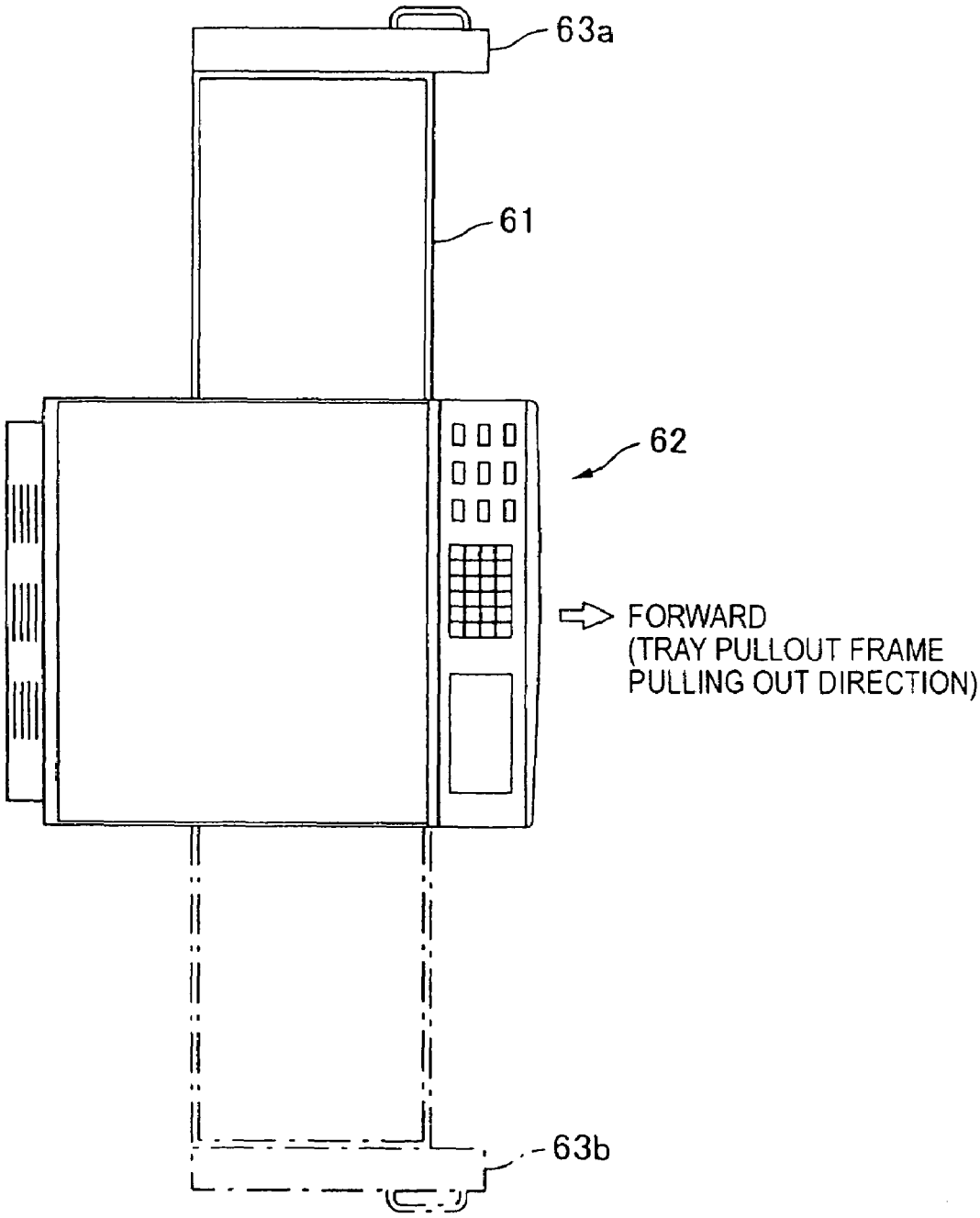
FIG. 8 is a schematic plan view for use in illustration of the function of the image forming apparatus according to another embodiment of the invention.

FIG. 8 is a schematic plan view for use in illustration of the function of an image forming apparatus according to another embodiment of the invention.

The image forming apparatus includes an image forming portion and a recording sheet storing portion similarly to the image forming apparatus shown in FIG. 1, and the recording sheet storing portion has a tray pullout frame that can be pulled out forward, and a sheet tray provided in the tray pullout frame. The sheet tray 61 slides to the lateral side on the tray pullout frame while the tray pullout frame is mounted to the apparatus main body, and can be pulled out from the apparatus main body 62. Handle units 63*a* and 63*b* having the same structure as those in FIGS. 1 and 5 are provided on both sides of the sheet tray 61, and as shown in FIG. 8, the sheet tray 61 can be pulled out from any of the lateral sides of the apparatus main body 62.

A wheelchair user typically arranges a lateral side of the wheelchair to be parallel to the front surface of the apparatus in order to come near the apparatus for operation. Therefore, there could be difference in how easily the apparatus can be operated depending on whether the user approaches to the apparatus from the right side or from the left side. However, in the image forming apparatus described above, regardless of whether the wheelchair is directed to the right or left, the sheet tray 61 can be pulled out for paper replenishment from either the right or left side, whichever is convenient for operation. In this way, the operability by wheelchair users can be improved.

Figure 9:
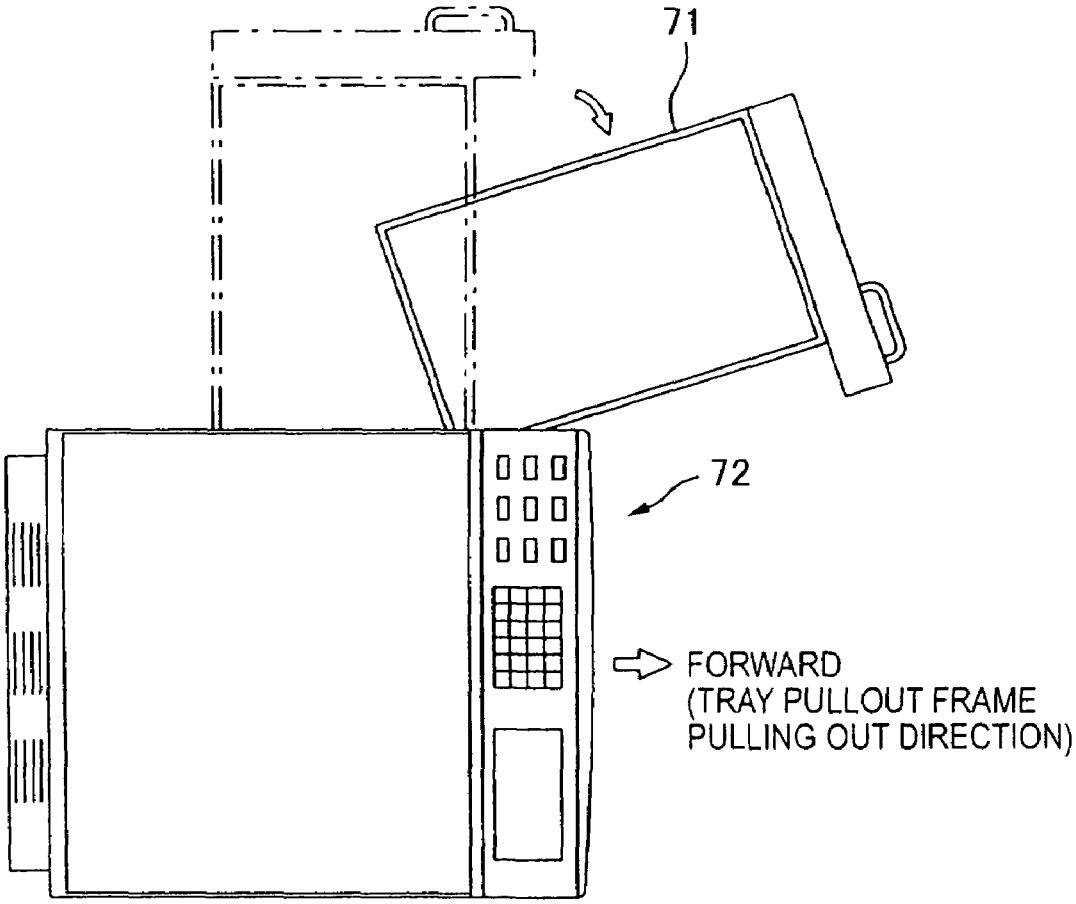
FIG. 9 is a schematic plan view for use in illustration of the function of an image forming apparatus according to another embodiment of the invention.

FIG. 9 is a schematic plan view for use in illustration of the function of an image forming apparatus according to another embodiment of the invention.

The image forming apparatus includes an image forming portion and a recording sheet storing portion similarly to the image forming apparatus shown in FIG. 1. The recording sheet storing portion includes a tray pullout frame that can be pulled out forward, and a sheet tray 71 that is provided in the tray pullout frame and can be pulled out to a lateral side. The sheet tray 71 can be pivoted horizontally forward as it is pulled out to the lateral side from the apparatus main body 72 as shown in FIG. 9.

Figure 10:
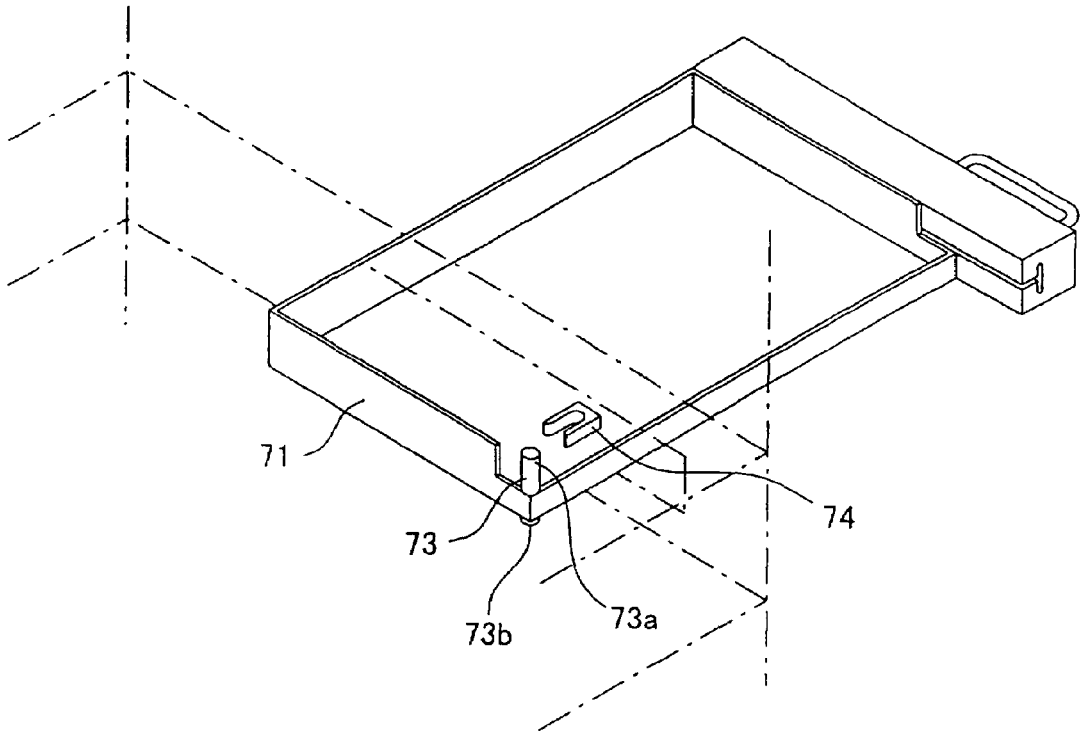
FIG. 10 is a schematic perspective view showing the structure of the sheet tray used in the image forming apparatus shown in FIG. 9.
Figure 11:
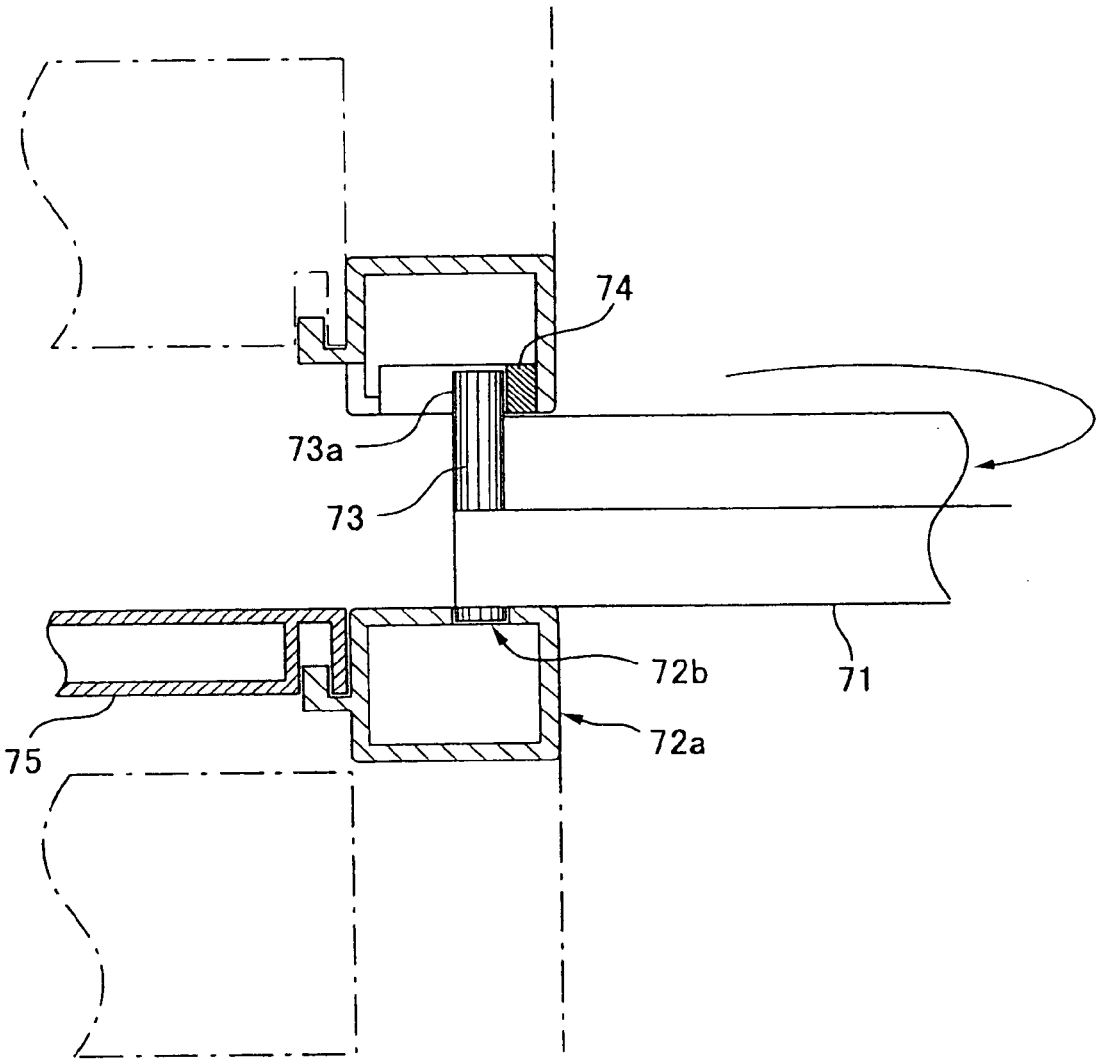
FIG. 11 is a schematic sectional view showing how the sheet tray in the image forming apparatus in FIG. 9 is pivotably supported.

As shown in FIG. 10, the sheet tray 71 is pivoted around a rotating shaft 73 provided on the lateral back side of the sheet tray. The sheet tray is pulled out to the lateral side, so that the top 73*a* of the rotating shaft is fitted to a bearing 74 fixed to the apparatus main body 72. The part 73*b* of the rotating shaft that protrudes downward from the sheet tray 71 is fitted to a recess 72*b* provided on the apparatus main body side as shown in FIG. 11, and the rotating shaft 73 in the top and bottom positions is rotatably supported. In this way, the sheet tray 71 can be pivoted to the front side as the surface having the recording sheet thereon is kept level.

The sheet tray 71 is pulled out to the lateral side and pivoted on the front side and therefore a wheelchair user operating in front of the apparatus main body 72 can readily replenish the sheet tray with recording sheets.

Note that the reference character 72*a* in FIG. 11 designates the frame member for the part of the apparatus main body 72 supporting the rotating shaft 73. The reference character 75 designates the tray pullout frame.

Figure 12:
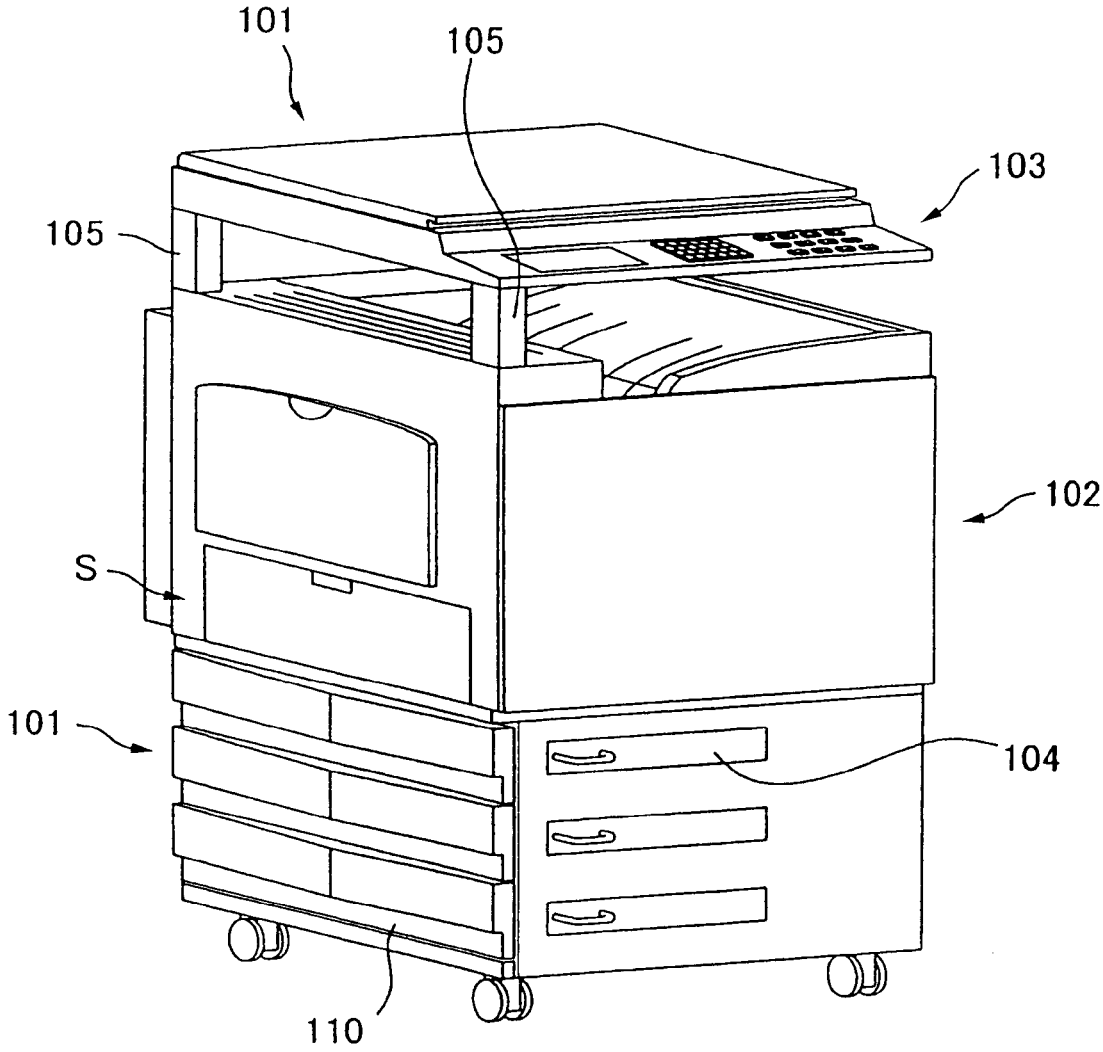
FIG. 12 is a schematic perspective view showing the state after changing the directions in which the image reading portion and the operation portion are set in the image forming apparatus in FIG. 1.

In the image forming apparatuses according to the embodiments described above, the tray pullout frame is pulled out in the direction toward the front side of the apparatus main body and the operation portion is provided in the direction. However, the operation portion and the image reading portion 101 integrally provided with the operation portion may be separable from the housing storing the image forming portion 102, and as shown in FIG. 12, an operation portion 103 and the image reading portion 101 may be provided in the direction in which the sheet tray and the handle unit 104 are pulled out. More specifically, the position of the intermediate foot portion 105 supporting the image reading portion 101 and the position where the housing storing the image forming portion 102 receives the intermediate foot portion 105 are appropriately set so that the unit including the image reading portion 101 and the operation portion 103 can be provided in any of two directions 90° shifted from each other depending on the user's choice.

In this way, in consideration of the condition or the location to provide the apparatus main body, and how often and by whom the apparatus is used and the like, the direction to pull out the sheet tray or the tray pullout frame can selectively be set as the front side at the time of using the apparatus.

As in the foregoing, in the image forming apparatus according to the first embodiment of the invention, the sheet tray can be pulled out from the main body of the image forming apparatus in any of the two directions, and therefore an operator operating standing in front of the apparatus or an operator in a wheelchair can pull out the tray in a direction that allows the operator easier operation and replenish the tray with recording sheets. Consequently, the operability by a non-handicapped user is not lowered while the operability by a wheelchair user can be improved. Upon a paper jam, the wheelchair user can readily restore the apparatus.

Figure 13:
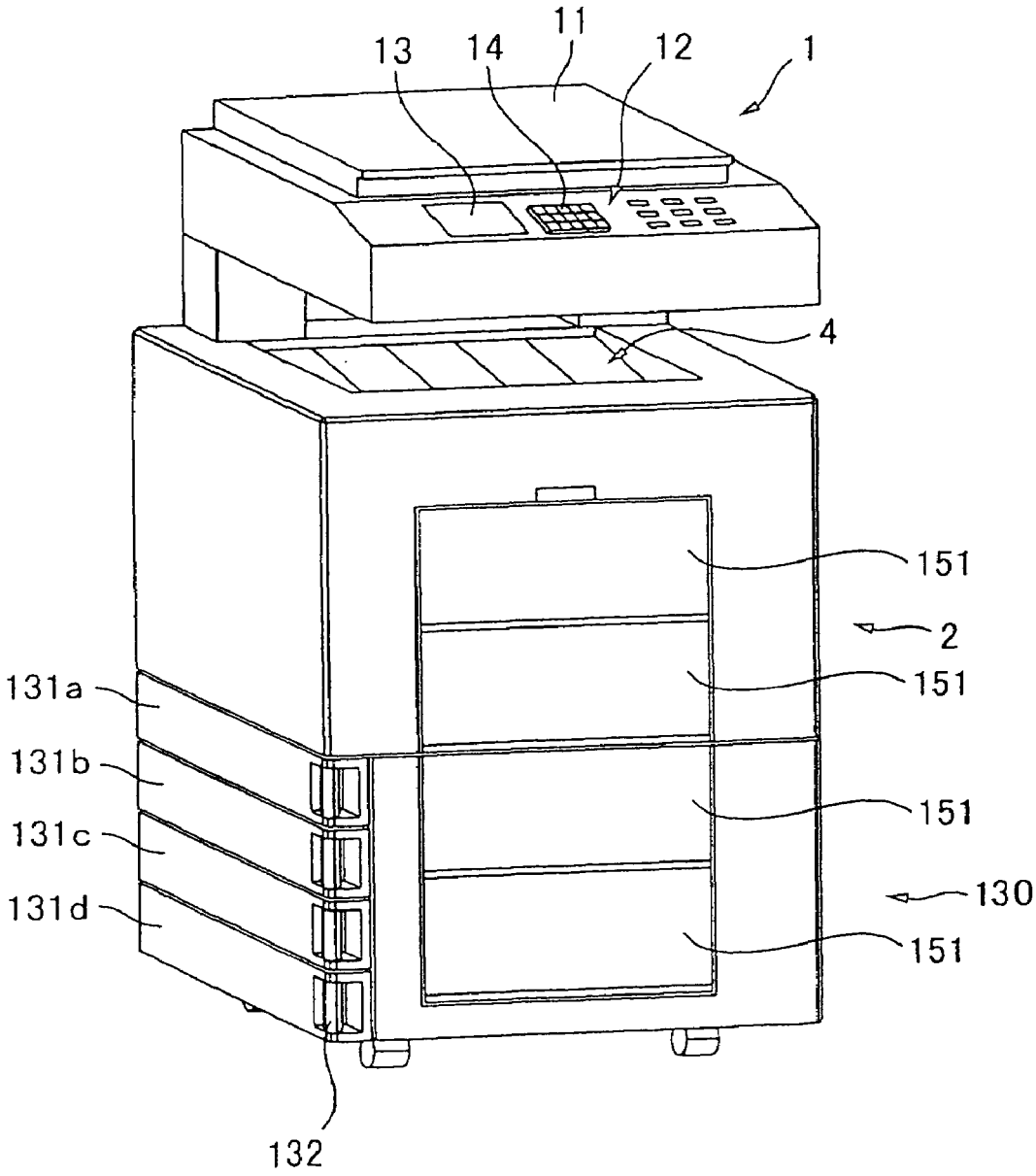
FIG. 13 is a perspective view of an image forming apparatus according to one embodiment of the invention.
Figure 14:
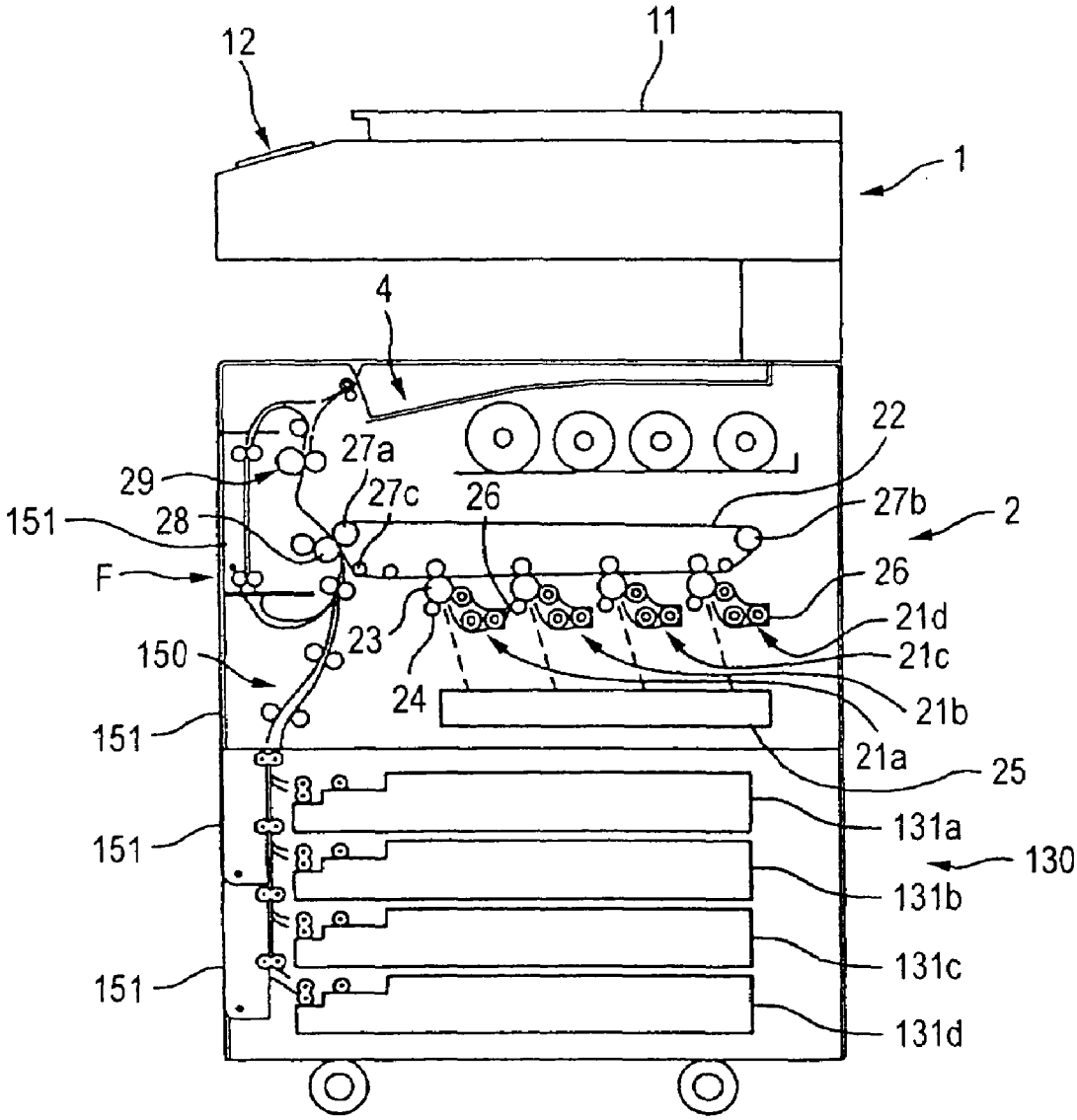
FIG. 14 is a schematic view of the image forming apparatus shown in FIG. 13.

FIG. 13 is a perspective view of an image forming apparatus according to a second embodiment of the invention. FIG. 2 is a schematic view of the image forming apparatus.

The image forming apparatus includes the image reading portion 1 that reads a document image and converts the image into an electrical image signal, the image forming portion 2 that forms a toner image based on the image signal and fixes the image on a recording paper sheet, and a recording paper sheet storing portion 130 that sequentially supplies recording paper sheets to the image forming portion 2.

The recording paper sheet storing portion 130 includes four paper feed trays 131*a*, 131*b*, 131*c*, and 131*d* that store recording paper sheets in different sizes and feed recording paper sheets on a one-sheet-basis, and a paper sheet transport path 150 that transports a recording paper sheet from these paper feed trays to the image forming portion 2 and the discharge tray 4 provided above the image forming portion.

Figure 15:
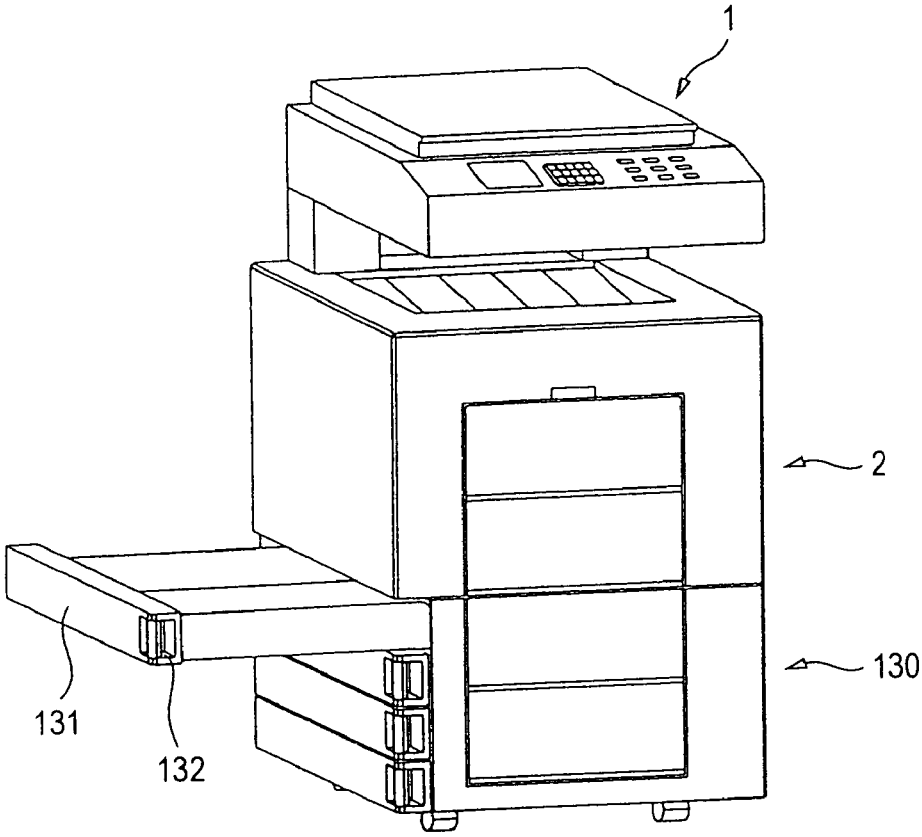
FIG. 15 is a schematic perspective view of the state in which a paper feed tray in the image forming apparatus in FIG. 13 is pulled out.
Figure 16A:
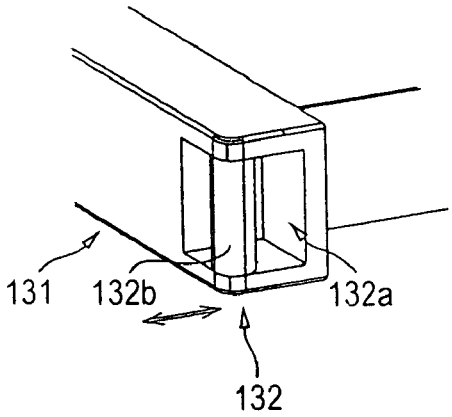
FIGS. 16A and 16B are enlarged perspective views of the handle of the paper feed tray.
Figure 16B:
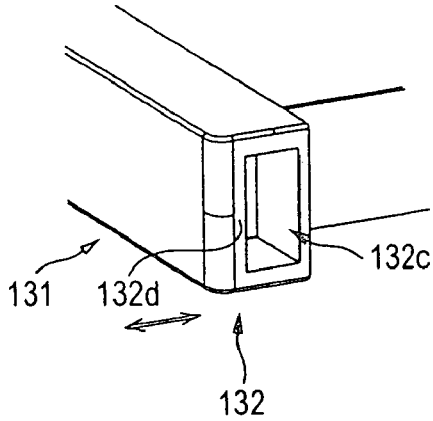

As shown in FIG. 15, the paper feed trays 131 are supported such that they can each be pulled out to a lateral side of the apparatus main body and replenished with recording paper sheets. A handle 132 for the operator to grasp in order to pull out the paper feed tray 131 is provided at its front end. As shown in FIG. 16A, the handle 132 has a recess 132*a* and a pillar portion 132*b* provided at the front part of the recess, and the operator puts a finger through the recess portion 132*a* to hold the pillar portion 132*b* with the finger and can easily pull out the paper feed tray to a lateral side from its front part. As shown in FIG. 16B, the handle may have a recess portion 132*c* open to the front side and a wall shaped portion 132*d* provided at the side of the recess 132*c*. In this way, the operator can pull out the paper feed tray 131 as he/she may hold the wall portion 132*d* with a finger(s) so that the paper feed trays 131 can be pulled out to the lateral side.

Figure 17:
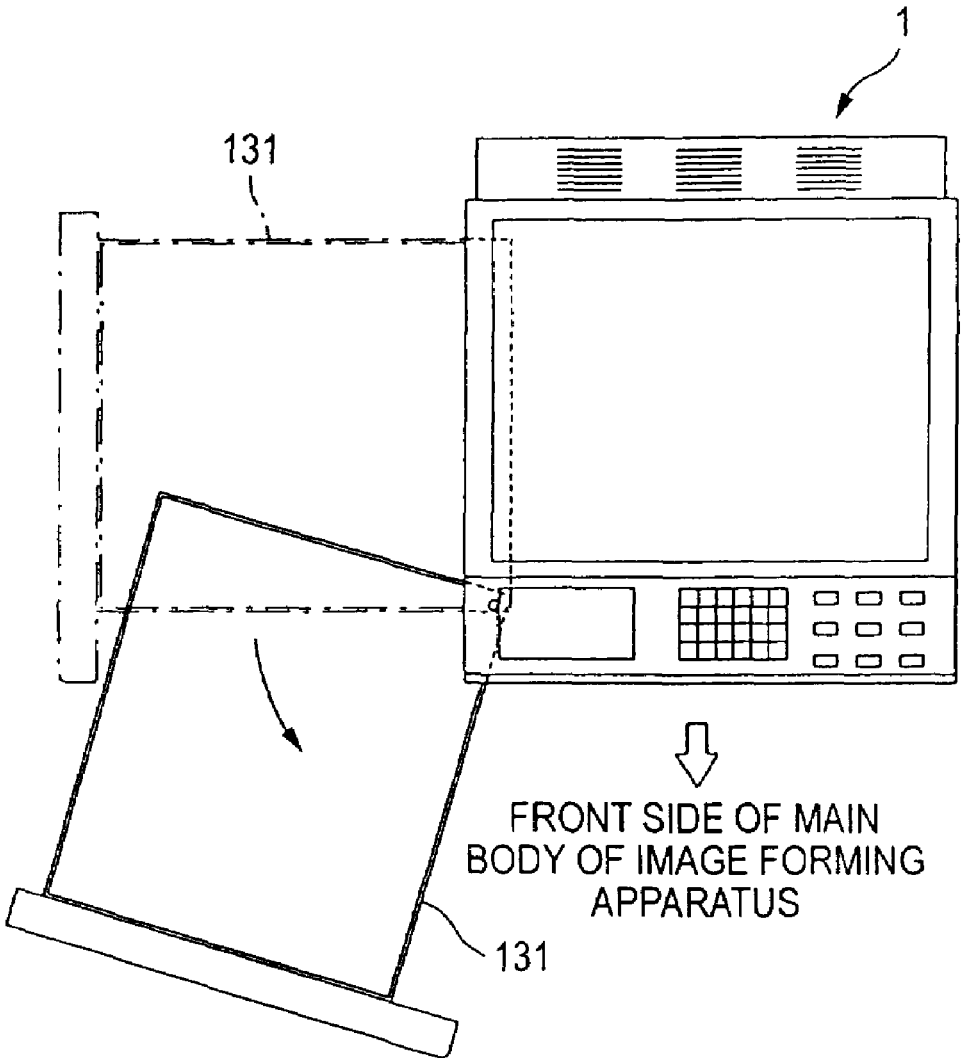
FIG. 17 is a schematic plan view of the state in which the paper feed tray in the image forming apparatus in FIG. 13 is pulled out and then pivoted to the front side.

As shown in FIG. 17, the above described paper feed tray can be pivoted horizontally to the front side as it is pulled out to the lateral side from the apparatus main body.

Figure 18:
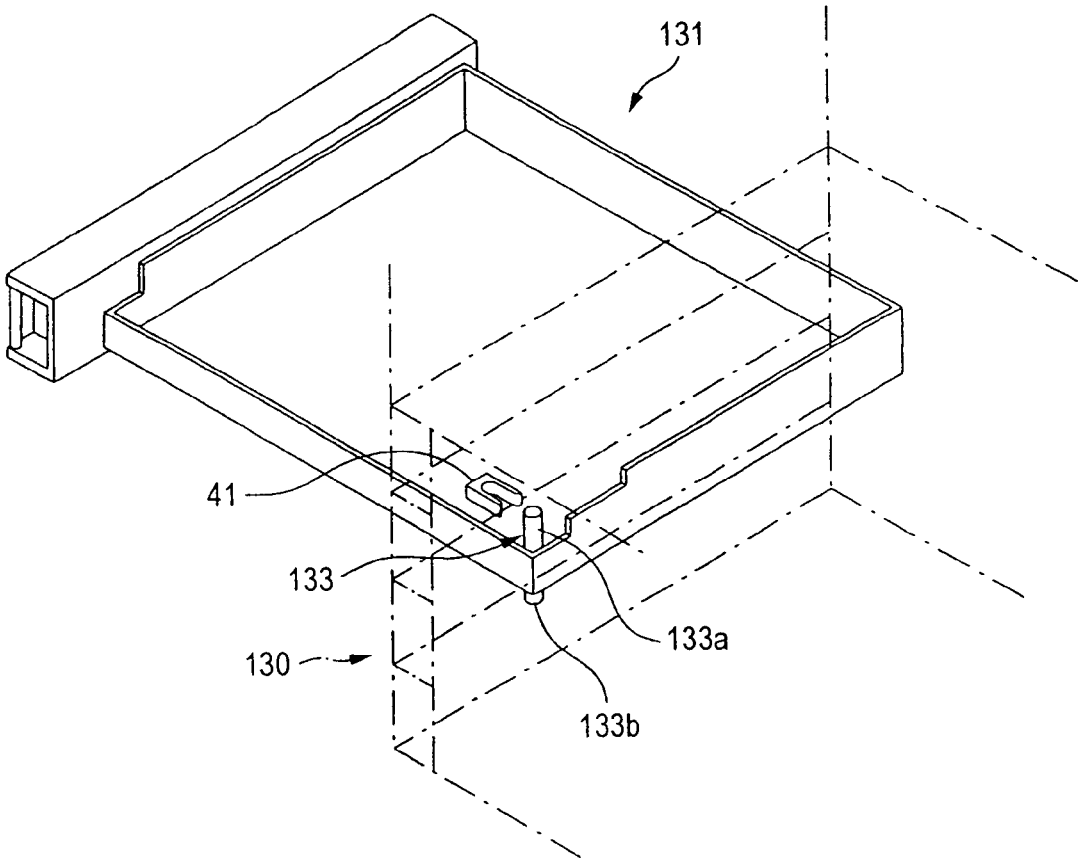
FIG. 18 is a schematic perspective view showing how the paper feed tray in the image forming apparatus in FIG. 13 is pivotably supported.
Figure 19:
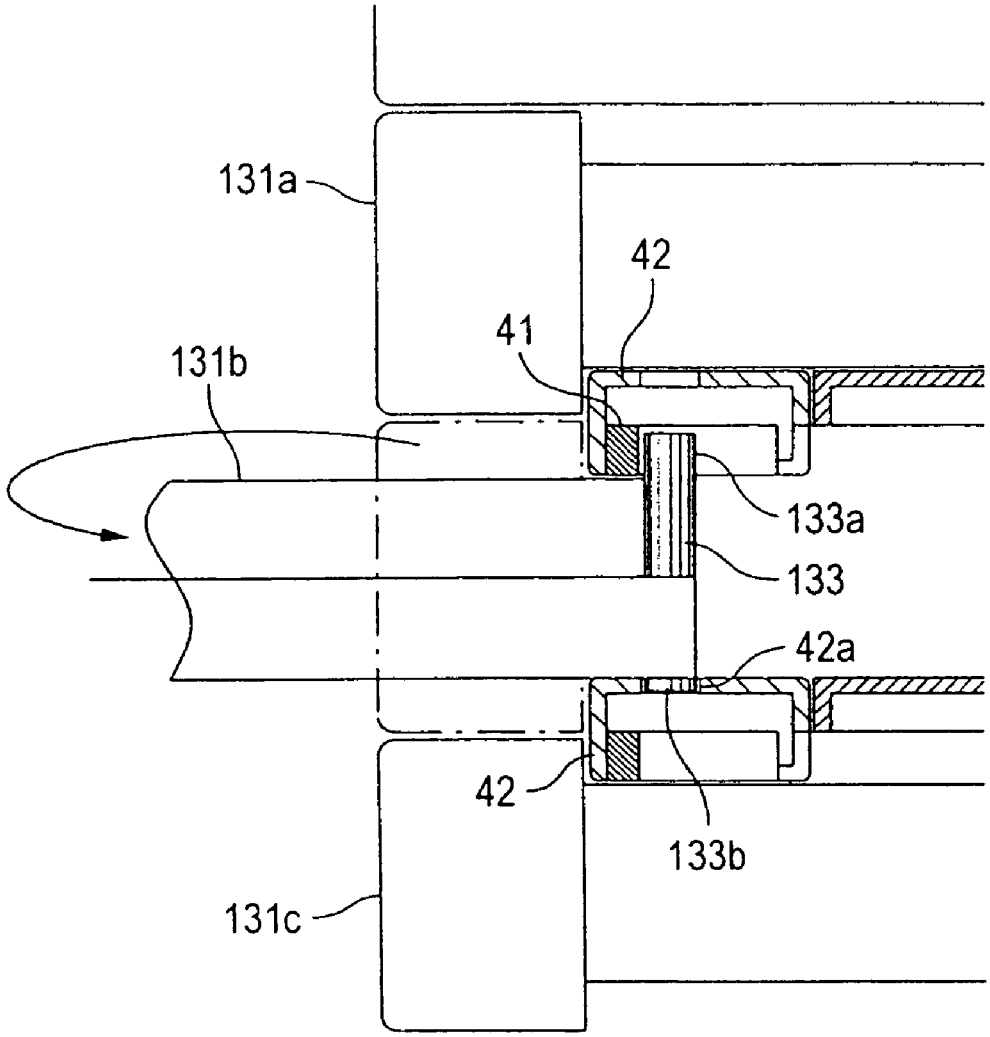
FIG. 19 is a schematic sectional view showing how the paper feed tray in the image forming apparatus in FIG. 13 is pivotably supported.

As shown in FIG. 18, the paper feed tray 131 is pivoted around a rotating shaft 133 provided in the vertical direction on the lateral back side of the paper feed tray 131, i.e., at the furthermost part of the tray. The top part 133*a* of the rotating shaft 133 is fitted to the bearing 41 fixed to the apparatus main body by pulling out the paper feed tray 131 to the lateral side. The part 133*b* of the rotating shaft 133 that protrudes below the paper feed tray 131 is fitted into the recess 42*a* of the support frame 42 provided on the apparatus main body side as shown in FIG. 19, so that the rotating shaft 133 in the top and bottom positions is rotatably supported. Since the rotating shaft 133 is provided on the front side of the main body of the image forming apparatus, the paper feed tray 131 can be pivoted to the front side of the apparatus main body as the surface having the recording paper sheets thereon is kept level.

Meanwhile, the paper sheet transport path 150 to the image forming portion 2 from the paper feed tray 131 is provided to transport a recording paper sheet upwardly along the front side F of the apparatus main body. The sheet is transported upwardly along the apparatus front surface F from the location where the intermediate transfer belt 22 and the transfer roller 28 meet further to the discharge tray 4 through the fixation device 29.

Therefore, the paper sheet transport path 150 to pull out a recording paper sheet from each of the plurality of paper feed trays 131 placed on each other in the vertical direction does not cross the direction in which the paper feed trays 131 are pulled out, so that the structure of the paper sheet transport path and the paper feed tray may be simple.

Figure 20:
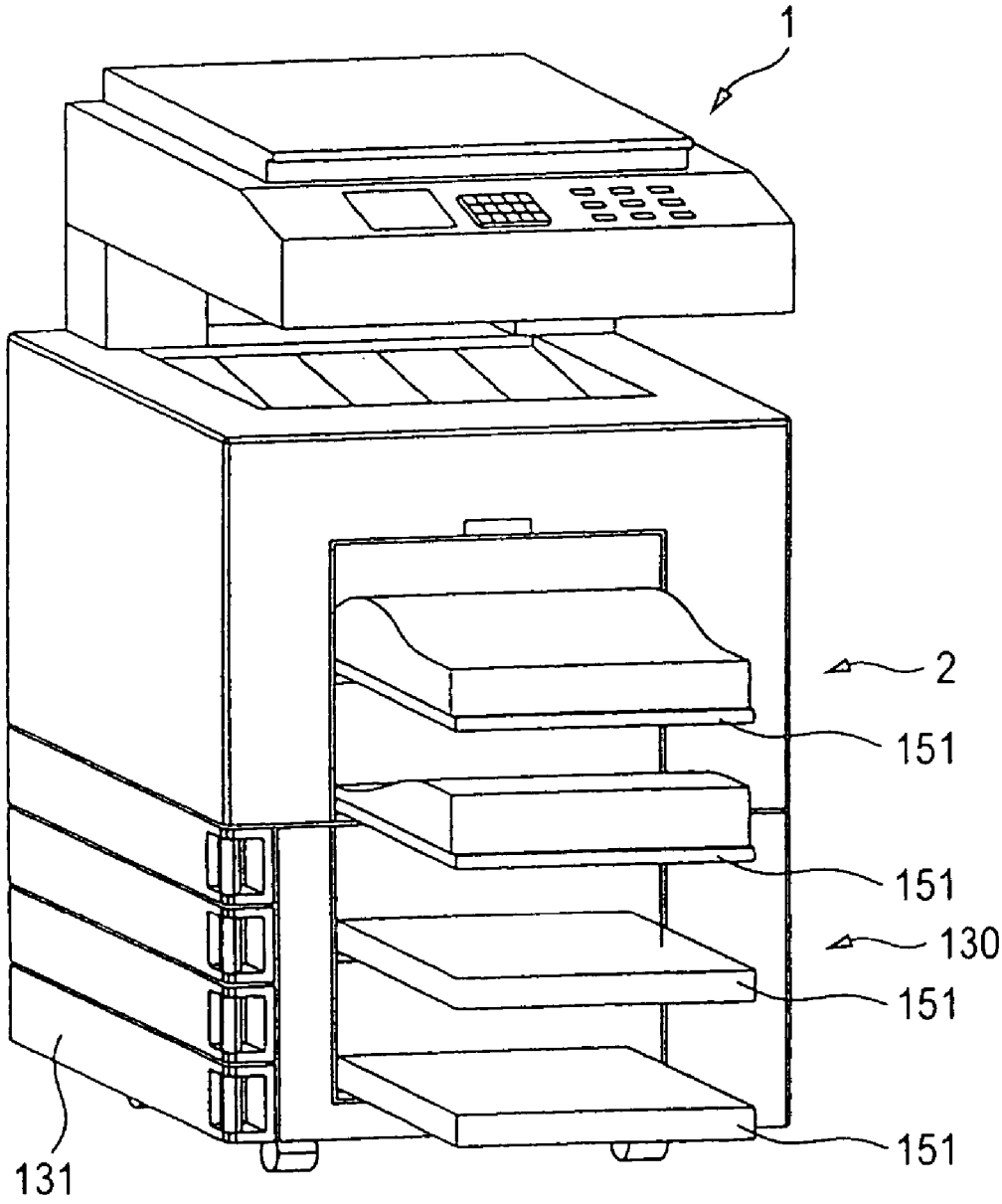
FIG. 20 is a schematic perspective view showing the state in which the transport path cover in the image forming apparatus in FIG. 13 is open.

The paper sheet transport path from the recording paper sheet storing portion 130 to the discharge tray 4 is provided along the front surface of the apparatus. Therefore, by opening the transport path cover 151 provided at the front surface of the apparatus, the paper sheet guides to guide the front and back surfaces of a recording paper sheet separate, so that the transport path is open to the front side. As shown in FIG. 13, the transport path cover 151 is divided into four parts and each of the part pivots around the horizontal pivot shaft provided at the lower end of the cover part, and is opened as the upper part turns forward as shown in FIG. 20.

In the image forming apparatus as described above, in response to an image signal generated at the image reading portion 1 or an externally input image signal, the surface of the photoreceptor drum 23 is substantially homogeneously charged by a charger 24 in each of the image forming units 21, and light from the image exposure device 25 is irradiated based on the image signal. In this way, a latent image according to the difference in electrostatic potential is formed on the surface of the photoreceptor drum 23. Then, as the photoreceptor drum 23 rotates, toner is transferred from the developing device 26 and toner images are formed as a result and sequentially transferred to the intermediate transfer belt 22 as they are placed on each other.

In the same timing as the above, a recording paper sheet corresponding to information on an image size recognized by the image reading portion 1 or an externally input image size is fed from the recording paper sheet storing portion 130 into the image forming portion 2.

When the recording paper sheet is fed between the intermediate belt 22 and the transfer roller 28, the toner image is transferred from the intermediate transfer belt 22 onto the recording paper sheet in an electric field formed by applied transfer bias voltage. Then, the recording paper sheet holding the toner image yet to be fixed is transported to the fixation device 29, and heated/pressurized between the heating roller and pressurizing roller of the fixation device 29 and the toner image is fused and fixed under pressure on the recording paper sheet.

Figure 21:
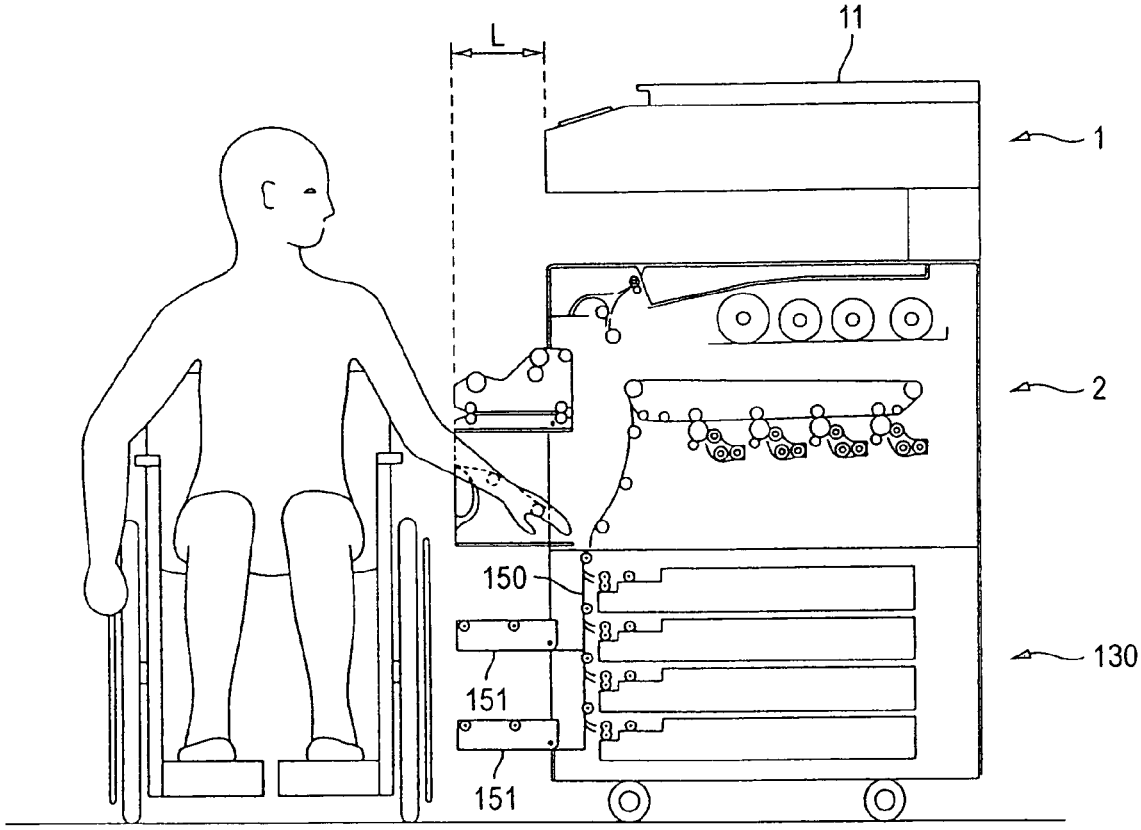
FIG. 21 is a schematic view showing how an operator seated in a wheelchair addresses a paper jam in the image forming apparatus in FIG. 13.
Figure 22:
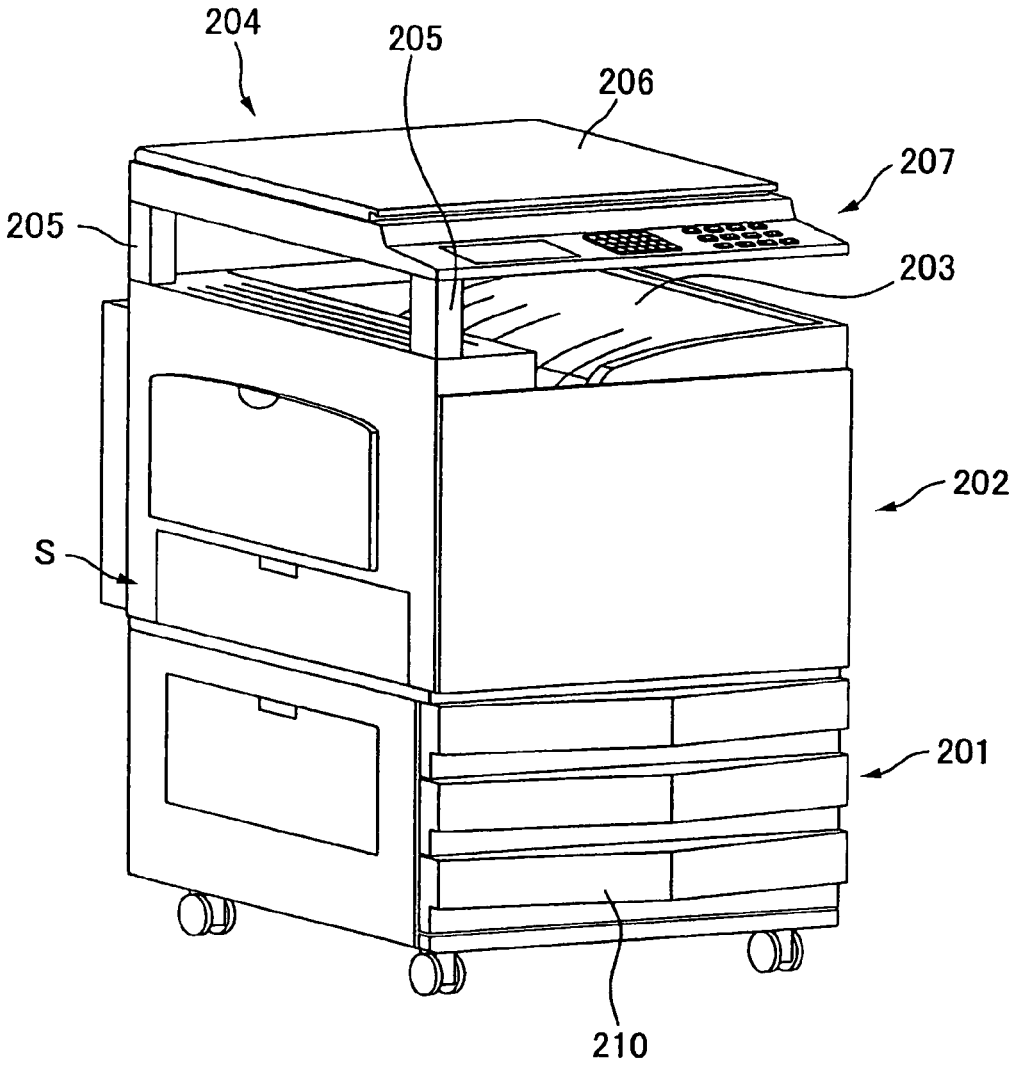
FIG. 22 PRIOR ART
FIG. 22 is a schematic perspective view of a conventional image forming apparatus.

In the above step, the transportation of a recording paper sheet can be obstructed for some reason. In such a case, the recording paper sheet stops somewhere in the transport path, and in order to continue the image forming operation, the recording paper sheet stopped in the path must be removed. At the time, the transport path cover 151 is opened, and the stuck recording paper sheet is removed. Since the transport path cover 151 is provided on the front side of the apparatus, the operator can remove the stuck recording paper sheet without moving from the normal operation position. Therefore, an operator in a wheelchair can readily carry out the operation. The transport path cover 151 is divided into a plurality of parts, and its size in the vertical direction can be small. In this way, when the cover is pivoted around the pivot shaft provided at the lower end and the paper sheet transport path 150 is opened, the forward protruding length L can be small. Therefore, as shown in FIG. 21, the operator in the wheelchair can operate near the apparatus rather than being away from the apparatus main body to open the transport path cover 51 and remove the recording paper sheet. Consequently, the operator in the wheelchair can also correctly observe the position or state of the stuck recording paper sheet, and address the trouble appropriately.

When a paper feed tray is replenished with recording paper sheets, the handle may be grasped to pull out the paper feed tray to a lateral side and then the tray can be pivoted toward the front side, so that the part storing the recording sheets comes near the operator in front of the apparatus main body, and therefore the operator can readily replenish the tray with recording paper sheets without moving.

What is claimed is:

1. An image forming apparatus comprising:

a user control portion disposed at a front side of a main body of the image forming apparatus;

an image forming portion configured to form a visible image on a recording sheet;

a sheet storing portion that sequentially feeds recording sheets to said image forming portion, said sheet storing portion comprising at least one sheet tray that stores a stack of recording sheets and is horizontally movable in two directions, which intersect with each other; and a transport path that sequentially transports the recording sheets fed from the sheet storing portion to said image forming portion;

wherein the main body of the image forming apparatus comprises a plurality of openable covers on a front side wall thereof, and at least a part of said transport path is exposed by opening at least one of the plurality of openable covers;

wherein said at least one sheet tray is provided in a tray pullout frame that is movable in one direction relative to the main body of the apparatus, and said at least one sheet tray is movable in a direction substantially orthogonal to the direction in which the pullout frame is pulled out relative to the main body of the apparatus;

wherein a feed roll that sequentially feeds recording sheets from said at least one sheet tray is supported by said tray pullout frame.

2. The image forming apparatus according to claim 1, further comprising:

a handle unit supported to be exposed on the outer side of the main body of the image forming apparatus and engaged with said sheet tray while said tray pullout frame is stored in the apparatus main body, wherein:

said handle unit is coupled with said sheet tray and is movable in the horizontal direction; and when said tray pullout frame is pulled out, the sheet tray and said handle unit are disengaged.

3. The image forming apparatus according to claim 1, wherein said sheet tray is movable both in the direction in which said tray pullout frame is pulled out and in the direction of the axis line orthogonal to said direction.

4. The image forming apparatus according to claim 1, further comprising:

a transport path that transports recording sheets sequentially fed from said sheet storing portion to said image forming portion, wherein:

a plurality of said sheet trays and tray pullout frames are both placed on each other in the vertical direction, and the direction in which the tray pullout frame is pulled out coincides with the direction in which said recording sheets are fed; and said transport path is provided so that a recording sheet fed from one sheet tray is penetrated through the tray pullout frames storing the other trays in the vertical direction.

5. The image forming apparatus according to claim 4, wherein the front part of said tray pullout frame in the direction in which said tray pullout frame is pulled out is openable so that said transport path is exposed while the tray pullout frame is stored in the apparatus main body of the apparatus.

6. The image forming apparatus according to claim 1, further comprising:

an upper unit provided on a housing storing said image forming portion and said sheet storing portion, and having an operation panel, wherein the upper unit is settable so that in which direction the front side of said operation panel is set is selectable among a plurality of directions on said housing.

7. The image forming apparatus according to claim 1, wherein at least one sheet tray is horizontally movable in three directions relative to the main body of the image forming apparatus.

8. The image forming apparatus according to claim 1, wherein the two directions are substantially orthogonal to each other.

9. The image forming apparatus according to claim 1, wherein the transport path is disposed near the front side of the main body of the image forming apparatus.

10. An image forming apparatus comprising:

an image forming portion that forms a visible image on a recording sheet;

a sheet storing portion that stores a plurality of recording sheets and sequentially supplying recording sheets to said image forming portion; and a transport path that transports the recording sheets sequentially supplied by said sheet storing portion to said image forming portion, wherein:

said sheet storing portion comprises a plurality of sheet trays that are placed on each other in the vertical direction and is movable in the horizontal direction relative to the apparatus main body;

the direction in which the sheet tray is pulled out coincides with the direction in which said recording sheets are fed, and the sheet tray is movable in two directions substantially orthogonal to each other; and said transport path is provided to run from a singular sheet tray and penetrate through the other sheet trays in the vertical direction;

wherein the sheet trays are provided in a tray pullout frame that are movable in one direction relative to the main body of the apparatus, and the sheet trays are movable in a direction substantially orthogonal to the one direction in which the pullout frame is pulled out relative to the main body of the apparatus;

wherein a feed roll that sequentially feeds recording sheets from the sheet trays are supported by the tray pullout frame.

11. The image forming apparatus according to claim 10, wherein said front portion of the sheet tray in the direction in which said the sheet tray is pulled out is openable so that said transport path is exposed while the sheet tray is stored in the apparatus main body.

12. An image forming apparatus comprising:

an image forming portion configured to form a visible image on a recording sheet;

a sheet storing portion that sequentially feeds recording sheets to the image forming portion, the sheet storing portion comprising at least one sheet tray that stores a stack of recording sheets and is horizontally movable in first and second directions, which intersect with each other;

a transport path that sequentially transports the recording sheets fed from the sheet storing portion to the image forming portion; and a plurality of openable covers, wherein at least one of the plurality of openable covers is opened, at least a part of the transport path is exposed to an outside of the image forming apparatus in the first direction;

wherein the at least one sheet tray is provided in a tray pullout frame that is movable in the first direction relative to a main body of the image forming apparatus, and the at least one sheet tray is movable in the second direction substantially orthogonal to the first direction in which the tray pullout frame is pulled out relative to the main body of the image forming apparatus;

wherein a feed roll that sequentially feeds recording sheets from the at least one sheet tray is supported by the tray pullout frame.

* * * * *